US006641404B2

(12) United States Patent
Matsuzaki et al.

(10) Patent No.: US 6,641,404 B2
(45) Date of Patent: Nov. 4, 2003

(54) ROTARY CONNECTOR USING PLURALITY OF FLEXIBLE CABLES

(75) Inventors: Nobuo Matsuzaki, Miyagi-ken (JP); Kenichi Saiso, Miyagi-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 10/078,117

(22) Filed: Feb. 19, 2002

(65) Prior Publication Data

US 2002/0115312 A1 Aug. 22, 2002

(30) Foreign Application Priority Data

Feb. 21, 2001 (JP) ..... 2001-045210
Feb. 21, 2001 (JP) ..... 2001-045211

(51) Int. Cl.[7] ..... H01R 39/00
(52) U.S. Cl. ..... 439/15; 439/164
(58) Field of Search ..... 439/15, 164

(56) References Cited

U.S. PATENT DOCUMENTS 5,865,634 A 2/1999 Best ..... 439/164
5,890,921 A 4/1999 Kuroda et al. ..... 439/164
6,364,676 B2 * 4/2002 Bunselmeier et al. ..... 439/164
6,371,779 B2 * 4/2002 Matsumoto ..... 439/164

FOREIGN PATENT DOCUMENTS

WO WO 00/76811 * 12/2000

* cited by examiner

*Primary Examiner*—Tulsidas Patel
(74) *Attorney, Agent, or Firm*—Brinks Hofer Gilson & Lione

(57) ABSTRACT

There are provided a fixed side housing, a movable side housing pivotably mounted to the fixed side housing, a plurality of flexible cables contained in a space formed between the fixed side housing and the movable side housing in a laminated state and a single piece of lead block having a plurality of first connection terminals connected with at least ones of respective ends of the plurality of flexible cables.

20 Claims, 17 Drawing Sheets

ROTARY CONNECTOR USING PLURALITY OF FLEXIBLE CABLES

BACKGROUND OF THE INVENTION

1. Field of the Invention

The present invention relates to a rotary connector Attached to a steering apparatus of an automobile or the like and used as respective electric connecting means between electric apparatuses such as a steering heater apparatus and an air bag system provided to a vehicle body and the like.

2. Description of Related Art

Conventionally, there has been proposed a rotary connector for electrically connecting an electric apparatus provided to a steering apparatus such as a steering heater and an electric apparatus provided to a vehicle body.

The rotary connector enables electric connection between an electric apparatus provided to a steering wheel constituting a rotary member and an electric apparatus provided to a vehicle body constituting a fixed member, contains a flexible electric cable or optical fiber cable (hereinafter, these are collectively referred to as "flexible cable") wound in a space in a case constituting a rotor portion (movable side housing) driven to rotate (pivot) by the steering wheel and a stator portion (fixed side housing), and fixes one end thereof to the rotor portion and other end thereof to the stator portion to thereby enable electric connection between the respective electric apparatus by utilizing winding and rewinding the flexible cable.

An explanation will be given of a conventional rotary connector in reference to the drawing.

FIG. 28 is a plane view showing a conventional rotary connector, FIG. 29 is a plane view of an essential portion showing a flexible cable of the conventional rotary connector, FIG. 30 is a side view of the essential portion showing the flexible cable of the conventional rotary connector, FIG. 31 is a plane showing a lead block of the conventional rotary connector, FIG. 32 is a side view showing the lead block of the conventional rotary connector, FIG. 33 is a plane view of an essential portion for explaining attachment of the flexible cable and the lead block of the conventional rotary connector and FIG. 34 is a side view of the essential portions for explaining attachment of the flexible cable and the lead block of the rotary connector.

As shown by FIG. 28, a rotary connector 120 is generally constituted by a fixed side housing 101, a movable side housing 102 rotatably connected to the fixed side housing 101, one sheet of flexible cable 103 constituting a flat cable contained in a space 114 formed between the fixed side and the movable side housings 101 and 102, a moving member 104 pivotably arranged between the fixed side and the movable side housings 101 and 102 and respective single pieces of lead blocks 105 and 106 connected to both ends of the one sheet of the flexible cable 103.

The fixed side housing 101 is provided with an outer cylinder 107 in a cylindrical shape, a bottom wall (not illustrated) in a circular shape provided at an end of the outer cylinder 107 and a hole (not illustrated) in a circular shape provided at a central portion of the bottom wall. Meanwhile, the movable side housing 102 is provided with an inner cylinder 108 in a cylindrical shape and an upper wall (not illustrated) substantially in a circular ring shape provided at one end of the inner cylinder 108, the outer cylinder 107 and the inner cylinder 108 are coaxially arranged and a containing portion 109 in a ring-like shape constituting the space 114 is partitioned between the two outer and inner cylinders 107 and 108.

The moving member 104 is arranged at inside of the containing portion 109 and the moving member 104 is constituted by a rotary plate 110 in a ring-like shape, a group of a plurality of rollers 111 supported on the rotary plate 110 and a pair of fixed columns 112 in a cylindrical shape having circular hollow holes The pair of fixed columns 112 are formed integrally with the rotary plate 110. Further, an opening 113 inserted with one flexible cable 103 is formed between one of the fixed columns 112 and the roller 111.

The flexible cable 103 is pasted with a plurality of (for example, four) of conductors 123 each comprising a copper foil (Cu) or the like in a strip-like shape having a very thin dimension on one face of an insulating film constituting a base film in a strip-like shape and for convenience, the flexible cable 103 is shown in white. An outer end of the flexible cable 103 is electrically and mechanically connected to the lead block 105 constituting a fixed side joint fixed to the outer cylinder 107 and is electrically led out to outside of the fixed side housing 101 via the lead block 105.

Further, an inner end of the flexible cable 103 is electrically and mechanically connected to the lead block 106 constituting a movable side joint-fixed to the inner cylinder 108 and is electrically led out to outside of the movable side housing 102 via the lead block 106.

Next, an explanation will be given of the conventional flexible cable in reference to the drawings.

As shown by FIG. 29 and FIG. 30, the flexible cable 103 in a strip-like shape constituting the flat cable, is provided with a first and a second insulating film 121 and 122 comprising a resin material of, for example, polyethylene terephthalate (PET) or the like, formed in a thin film shape, laminated in two sheets thereof and constituting a long-sizedbase film, and the conductor 123 in the strip-like shape arranged in a state in which a substantially total portion thereof is sandwiched between the first and the second insulating films 121 and 122, and comprising a plurality (for example, four) of copper foils (Cu) respectively formed in an equal width dimension and arranged in parallel at equal intervals.

Further, the respective conductor 123 is provided with a first base conductor 123*a* a total portion of which is sandwiched between the first and the second insulating films 121 and 122 and a first exposed conductor 123*b* extended from the first base conductor 123*a*, exposed from front ends of the first and the second insulating films 121 and 122 and projected outwardly.

Further, one face of the front end of the respective first exposed conductor 123*b* is pasted with a holding film 124 in a strip-like shape comprising PET or the like for holding a free end side of the respective first exposed conductor 123*b*.

Further, such a constitution is provided at both ends of the flexible cable 103.

Further, as shown by FIG. 31 and FIG. 32, the lead block 105 is provided with a base 131 comprising an insulating material and a plurality of first connection terminals 132 arranged to the base 131 by, for example, insert molding.

Further, the base 131 comprises, for example, an insulating synthetic resin material, formed by molding, constituted substantially by a rectangular shape and arranged with a through hole 131*a* in a rectangular shape substantially at a central portion of the base 131.

Further, a front end side (upper side of FIG. 31) of the base 131 is provided with an inclined base 131*b* projected outwardly from an upper face of the base 131.

The first connection terminal 132 is provided with a plurality (for example, four) of first connections 132*a* comprising a flat plate material of a conductive metal such as copper, formed by pressing, having a predetermined width dimension and arranged at equal intervals and first outer terminals 132*b* extended outwardly from the first connections 132*a*. The first connection terminal 132 is integrated with the base 131 by being insert-molded into the inclined base 131*b* of the base 131. The width dimension of the first connection terminal 132 is set to a width dimension substantially the same as the width dimension of the first base conductor 123*a* and the first exposed conductor 123*b* of the flexible cable 103.

Under the state, substantially the central portion of the first connection 132*a* of the first connection terminal 132 is arranged to span over the through hole 131*a* of the base 131, further, a surface of a rear end side (lower side of FIG. 31) of the first connection 132*a* and a surface of the base 131 are formed to constitute the same plane.

Next, an explanation will be given of attachment of the flexible cable and the lead block of the conventional rotary connector.

As shown by FIG. 33 and FIG. 34, an upper face of the base 131 of the lead block 105 is laminated and mounted with a side of the flexible cable 103 formed with the first exposed conductor 123*b*.

Further, in this state, the respective first connection 132*a* of the lead block 105 and the respective first exposed conductor 123*b* of the flexible cable 103 are arranged to laminate opposedly to each other, further, the respective first exposed conductor 123*b* is arranged above the through hole 131*a* of the lead block 105.

Further, the respective first connection 132*a* and the respective laminated first exposed conductor 123*b* are mechanically and electrically connected by pertinent means such as ultrasonic connecting means.

That is, the respective conductor 123 and the respective first connection terminal.132 are respectively connected individually.

The rotary connector 120 generally constituted in this way is used as electric connecting means of a steering heater apparatus, an air bag system for vehicle mounting, a horn circuit or the like by fixing the fixed side housing 101 to a vehicle body (not illustrated), further, the movable side housing 102 to a steering wheel member (not illustrated) and connecting both ends of the flexible cable 103 to respective electric apparatus on the vehicle side and the steering wheel side via the respective lead blocks 105 and 106 of the fixed side and the movable side.

That is, the rotary connector 120 functions as electric connecting means by respectively making a predetermined current flow in the plurality of respective conductors 123 of the flexible cable 103.

However, although according to the conventional rotary connector 120, the inside of the space 114 formed between the fixed side housing 101 and the movable side housing 102 is contained with the flexible cable 103, since the flexible cable 103 is formed such that the plurality (for example, four) of conductors 123 each comprising the copper foil (Cu) having the very thin dimension in the strip-like shape or the like are pasted on one face of the insulating film, a value of a current which can be made to flow to the respective conductor for the heater apparatus cannot be made so large.

Meanwhile, according to the heater apparatus for steering, in order to make the heater apparatus generate heat, it is requested to supply a comparatively large current value to the heater apparatus and therefore, there is a growing requirement to make the large value of a current flow to the conductor of the flexible cable 103. However, as described above, according to the conventional rotary connector 120, when a large value of a current is made to flow to the conductor of the flexible cable 103, by heat generation by wiring resistance of the conductor, heat is generated excessively and therefore, there is a limit in the current value and accordingly, there poses a problem in supplying a current value sufficient for making the heater apparatus generate heat via the flexible cable

SUMMARY OF THE INVENTION

It is an object of the invention to provide a rotary connector capable of making a large current flow to a conductor without increasing lead blocks even when a plurality of flexible cables are used.

According to an aspect of the invention, there is provided a rotary connector comprising a fixed side housing, a movable side housing pivotably mounted to the fixed side housing, a plurality of flexible cables contained in a space formed between the fixed side housing and the movable side housing in a laminated state, and a lead block having a plurality of first connection terminals connected with the plurality of flexible cables, wherein the plurality of flexible cables are constructed by a constitution in which at least one first base conductor in a strip-like shape is sandwiched between insulating films and includes a first exposed conductor constituted by extending and exposing the first base conductor from the insulating films, wherein the first exposed conductors extended from-the respective insulating films at the same position are electrically connected in a state of being laminated to each of the plurality of first connection terminals respectively, and wherein the same current is made to flow to the first base conductors of the plurality of flexible cables.

By such a constitution, there is achieved an effect of capable of providing the rotary connector capable of making a large current flow from the first connection terminal of the lead block to the plurality of first base conductors without increasing the lead blocks.

Further, according to another aspect of the invention, there is provided the rotary connector wherein the first base conductor is used for supplying power for a heater apparatus.

By such a constitution the rotary connector is preferably used particularly for supplying the power having a large current.

Further, according to another aspect of the invention, there is provided the rotary connector wherein the flexible cable is provided with at least one second base conductor for supplying a signal current in parallel with the first base conductor, wherein the lead block is provided with a second connection terminal electrically connected with the second base conductor and the second base conductor, and wherein the second connection terminal are electrically connected.

By such a constitution, there can be provided the rotary connector having multiple functions capable of supplying a current to a heater apparatus or the like and supplying also a current for a signal without increasing the lead blocks since the flexible cable can be provided in parallel with the first and the second base conductors for a plurality of uses.

Further, according to another aspect of the invention, there is provided the rotary connector wherein the first base conductor for supplying power and a plurality of the second base conductors for supplying the signal current are provided separately from each other at areas of the insulating films divided in two.

By such a constitution, the respective base conductors for power supply and for signal are separated and therefore, there can be provided the rotary connector outer connection of which is simple and easy.

Further, according to another aspect of the invention, there is provided the rotary connector wherein a width dimension of the base conductor for supplying power for the heater apparatus is set to a width dimension thicker than a width dimension of the second base conductor for supplying the signal current, and wherein a current capacity of the first base conductor is made larger than a current capacity of the second base conductor.

By such a constitution, a sufficiently large current capacity can be provided by reducing the width of the second base conductor for signal having a comparatively small current and enlarging the width of the first base conductor for power supply.

Further, according to another aspect of the invention, there is provided the rotary connector wherein one of the first connection terminals of the lead blocks includes a plurality of connections connected to each other, and wherein each of the connections is electrically connected with the first exposed conductor.

By such a constitution, by only connecting a plurality of the exposed conductors respectively to the connections, the exposed conductors can be connected in parallel, the current capacity of the exposed conductor can be increased, there can be provided the flexible cable having general purpose performance, further, a terminal number of outside terminals (outside connectors) connected to the lead block can be halved and the total cost can be reduced.

Further, according to another aspect of the invention, there is provided the rotary connector wherein the lead block is provided with a positioning portion comprising a projection, wherein the flexible cable is provided with an engaging portion fitted with the positioning portion, wherein the engaging portion of the flexible cable is fitted to the positioning portion, and wherein the flexible cable is positioned relative to the lead block.

By such a constitution, by positioning the flexible cable to the lead block, attachment of the lead block to the flexible cable can be facilitated and can be carried out inexpensively.

Further, according to another aspect of the invention, there is provided the rotary connector wherein the engaging portion is provided between contiguous ones of the first base conductors among the plurality of first base conductors.

By such a constitution, by the engaging portion provided between the contiguous base conductors, the flexible cable can be positioned relative to the lead block without reducing the width of the base conductor.

Further, according to another aspect of the invention, there is provided a rotary connector comprising a fixed side housing, a movable side housing pivotably mounted to the fixed side housing, at least two flexible cables contained in a space formed between the fixed side housing and the movable side housing in a laminated state, and a lead block having a plurality of first connection terminals connected with at least ones of respective ends of at least the two flexible cables, wherein at least the two flexible cables are constructed by a constitution in which a first base conductor in a strip-like shape is sandwiched between insulating films and include a first exposed conductor exposed from the insulating films and extended from the first base conductor, wherein the first exposed conductors extended from the respective insulating films of at least the two flexible cables at different positions in a width direction of the insulating films, are electrically connected to the respective first connection terminals in a state of being respectively laminated to the plurality of first connection terminals, and wherein the same current is made to flow to the first base conductors of at least the two flexible cables.

By such a constitution, there is achieved an effect of capable of providing the rotary connector capable of making a large current flow to the plurality of first base conductors without increasing the lead blocks.

Further, according to another aspect of the invention, there is provided the rotary connector wherein only one of the first base conductors of the flexible cable is provided to the insulating films by a width dimension more or less narrower than a width dimension of the insulating films.

By such a constitution, only a single piece of the first base conductor is provided by the width dimension more or less narrower than the width dimension of the insulating film and accordingly, the width of the first base conductor on the insulating film can be widened and there is achieved an effect of capable of making a current value capable of being made to flow to the first base conductor sufficiently large.

Further, according to another aspect of the invention, there is provided the rotary connector wherein an even number of sheets equal to or larger than four layers of at least the two flexible cables each formed with only one of the first base conductors are laminated, and wherein the first exposed conductors of the flexible cables of a number of a half of the even number are extended from the insulating films at the same position.

By such a constitution, there is achieved an effect of capable of making the current value capable of being made to flow to the first base conductor further sufficiently large.

Further, according to another aspect of the invention, there is provided the rotary connector wherein an even number of layers equal to or more than four of the flexible cables each formed with only one of the base conductors are laminated.

By such a constitution, there is achieved an effect of capable of making the current value capable of being made to flow to the first base conductor still further sufficiently large.

Further, according to another aspect of the invention, there is provided the rotary connector wherein a plurality of the first base conductors of each of at least the two flexible cables are provided at the insulating films in parallel with each other.

By such a constitution, the flexible cable is applicable to constitutions having multiple functions such as a heater apparatus, a horn apparatus, an air bag system, further, capable of making a large current flow.

Further, according to another aspect of the invention, there is provided the rotary connector wherein the plurality of the first base conductors are provided at the insulating films in parallel with each other, and wherein three layers or more of at least the two of flexible cables are laminated.

By such a constitution, there is achieved an effect of capable of making the current value capable of being made to flow to the first base conductor further sufficiently large.

According to another aspect of the invention, there is provided the rotary connector wherein each of at least the two flexible cables is provided with the first exposed conductor extended from the insulating films at the same position.

By such a constitution, there is achieved an effect of capable of making the current value capable of being made to flow to the first base conductor of each of at least the two flexible cables further sufficiently large.

Further, according to another aspect of the invention, there is provided the rotary connector wherein the first base conductor is used for supplying power for a heater apparatus.

By such a constitution, the rotary connector is preferably used particularly for supplying power having a large current.

Further, according to another aspect of the invention, there is provided the rotary connector wherein each of at least the two flexible cables is provided with a second base conductor for supplying a signal current in parallel with the first base conductor, wherein the lead block is provided with a second connection terminal electrically connected with the second base conductor and the second base conductor, and wherein the second connection terminal are electrically connected.

By such a constitution, there can be provided the rotary connector having multiple functions capable of supplying a current to a heater apparatus or the like and supplying also a signal current without increasing the lead blocks by providing the flexible cable with the first and the second base conductors for a plurality of uses in parallel with each other.

Further, according to another aspect of the invention, there is provided the rotary connector wherein the first connection terminal of the lead block includes a plurality of connections connected to each other, and wherein the respective connections are electrically connected with the first exposed conductors of the flexible cables.

By such a constitution, by only connecting a plurality of pieces of exposed conductors respectively to the connections, the exposed conductors can be connected in parallel, the current capacity of the exposed conductor can be increased, the flexible cable having general purpose performance can be provided, further, a terminal number of outside terminals (outside connectors) connected to the lead block can be halved and the total cost can be reduced.

Further, according to another aspect of the invention, there is provided the rotary connector wherein the lead block is provided with a positioning portion comprising a projection, each of at least the two flexible cables is provided with an engaging portion fitted with the positioning portion, wherein the engaging portion of each of at least the two flexible cables is fitted to the positioning portion, and wherein the flexible cable is positioned relative to the lead block.

By such a constitution, by positioning the flexible cable to the lead block, attachment of the flexible cable to the lead block can be facilitated and can be carried out inexpensively.

Further, according to another aspect of the invention, there is provided the rotary connector wherein a number of a half of a plurality of the flexible cables contained in the space formed between the fixed side housing and the movable side housing in the laminated state are turned back at positions different from each other in a U-like shape and provided in the space to be driven at turn-back positions at which the number of the half of the plurality of flexible cables are separated.

By such a constitution, operation in winding and rewinding the plurality of flexible cables is made smooth.

DETAILED DESCRIPTION OF PREFERRED EMBODIMENTS

Figure 1:
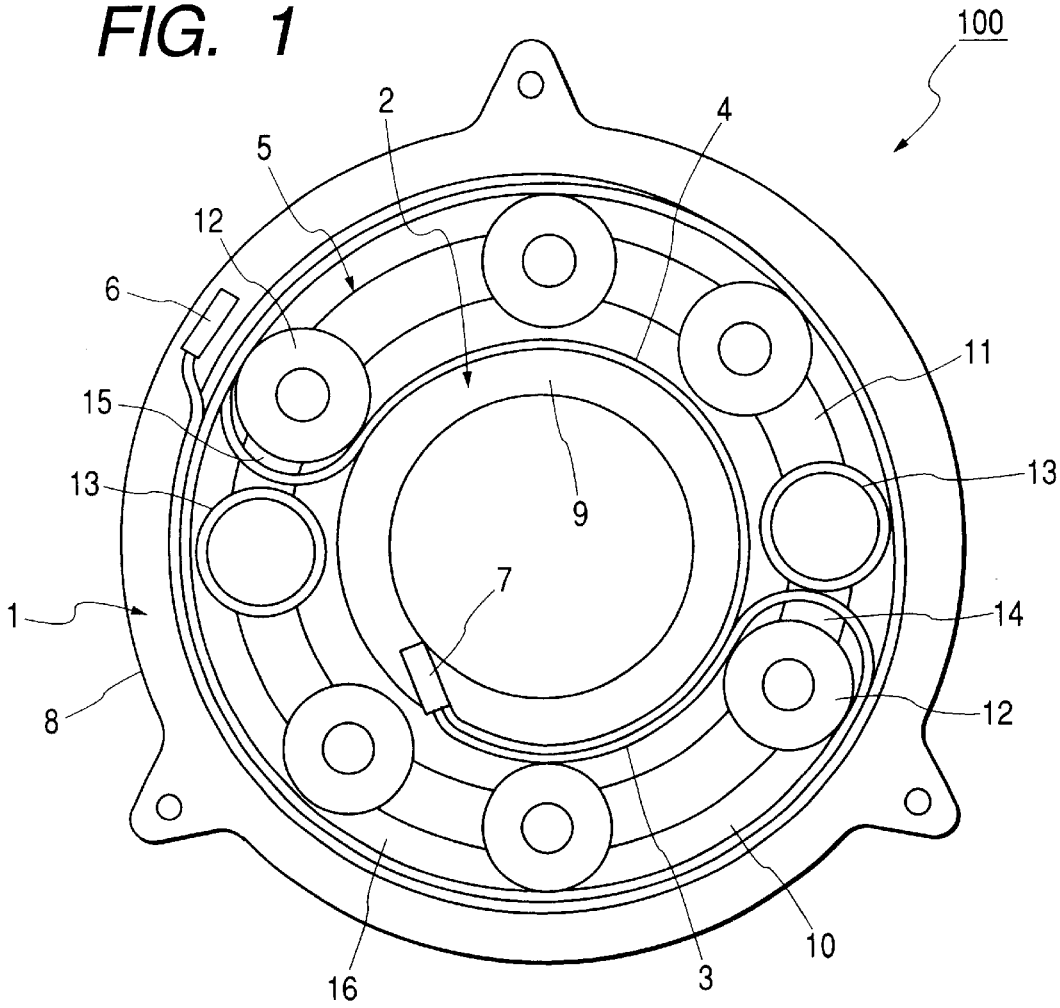
FIG. 1 is a plane view showing an embodiment of a rotary connector according to the invention.
Figure 2:
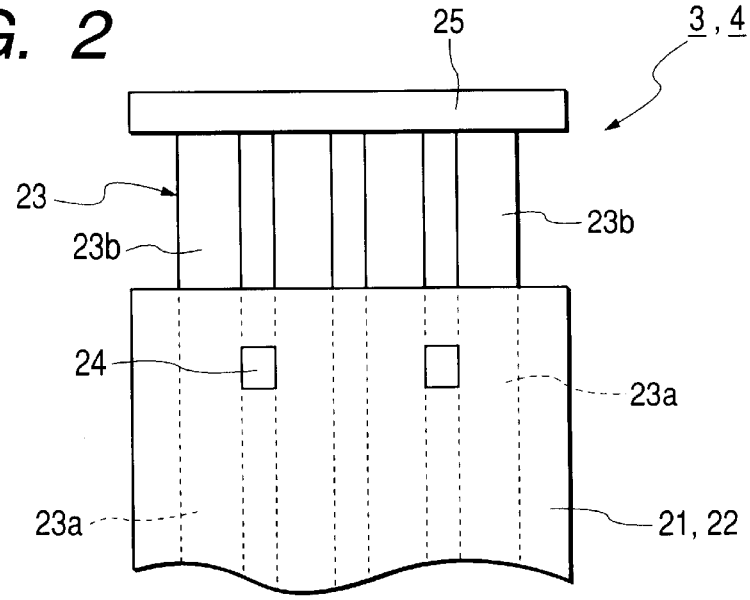
FIG. 2 is a plane view of an essential portion showing a first embodiment of a flexible cable of a rotary connector according to the invention.
Figure 3:
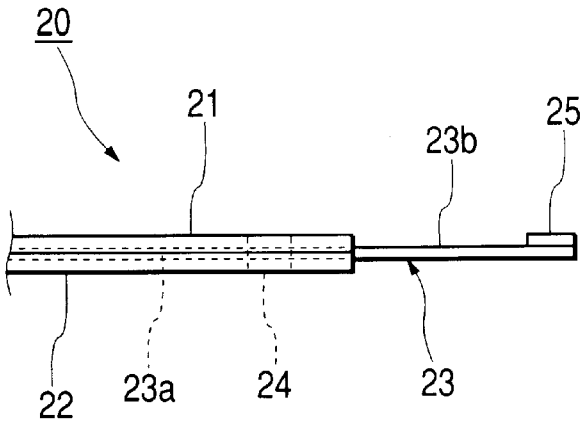
FIG. 3 is a side view of the essential portion showing the first embodiment of the flexible cable of the rotary connector according to the invention.
Figure 4:
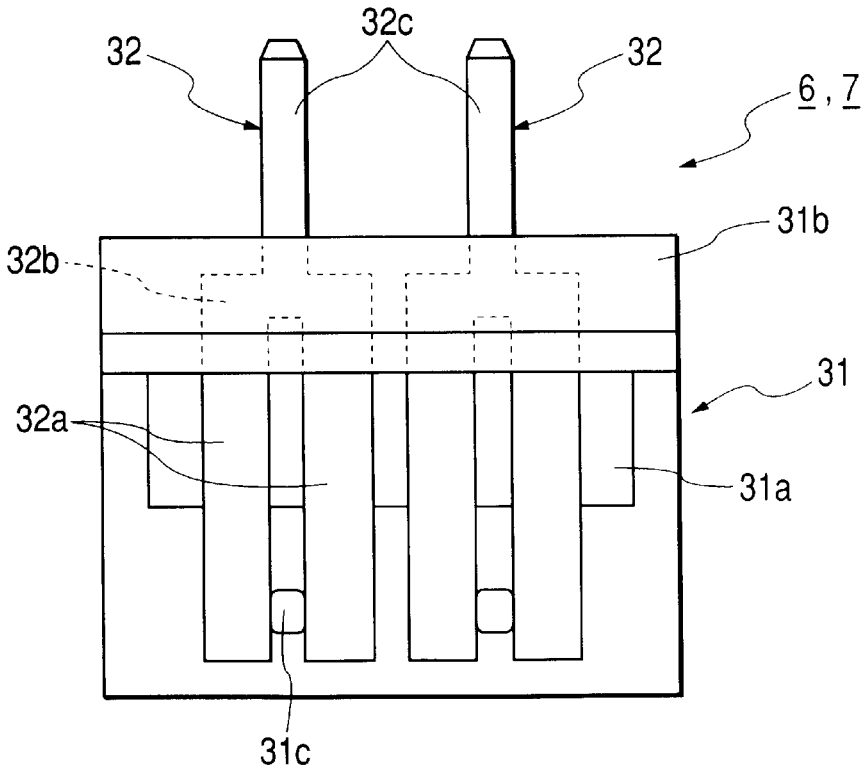
FIG. 4 is a plane view showing a first embodiment of a lead block of the rotary connector according to the invention.
Figure 5:
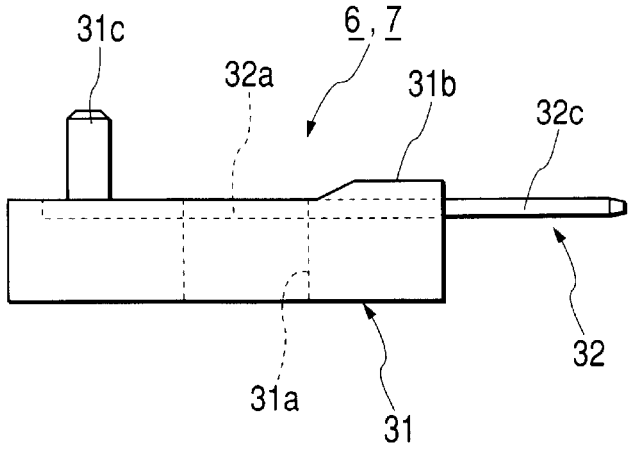
FIG. 5 is a side view showing the first embodiment of the lead block of the rotary connector according to the invention.
Figure 6:
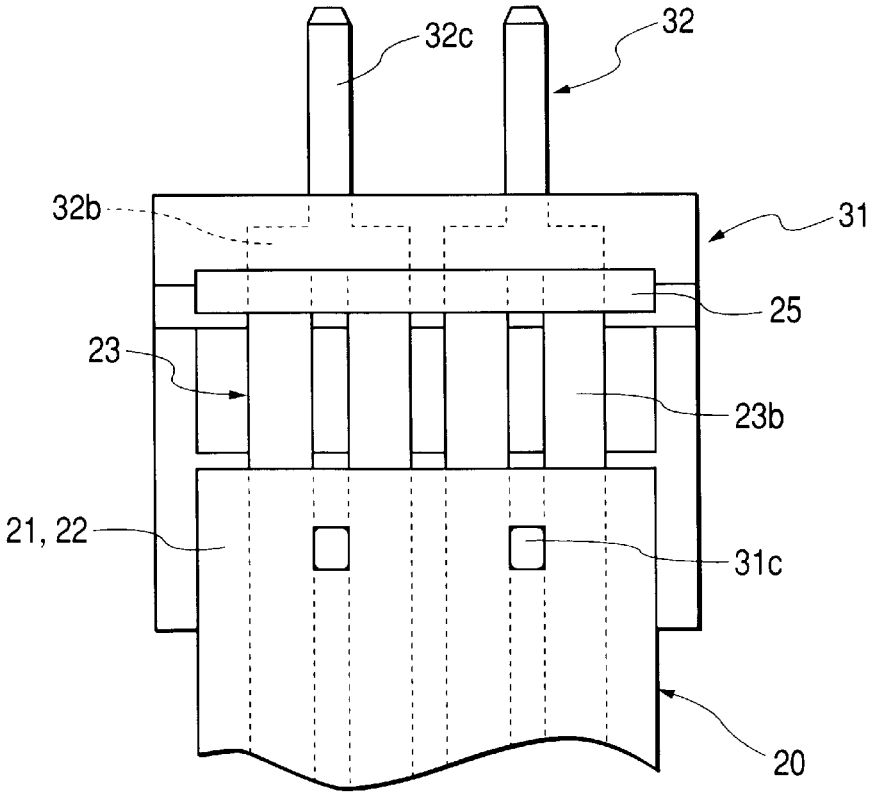
FIG. 6 is a plane view of an essential portion for explaining attachment of the flexible cable and the lead block of the rotary connector according to the invention.
Figure 7:
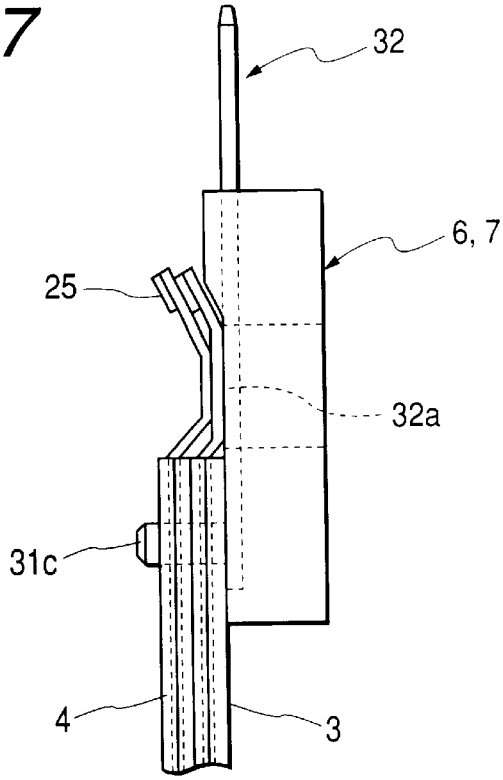
FIG. 7 is a side view of an essential portion for explaining attachment of the flexible cable and the lead block of the rotary connector according to the invention.

In the following, explaining drawings of a rotary connector according to the invention, FIG. 1 is a plane view showing a first embodiment of a rotary connector according to the invention, FIG. 2 is plane view of an essential portion showing the first embodiment of a flexible cable of the rotary connector according to the invention, FIG. 3 is a side view of the essential portion showing the first embodiment of the flexible cable of the rotary connector according to the invention, FIG. 4 is a plane view of an essential portion showing the first embodiment of a lead block of the rotary connector according to the invention, FIG. 5 is a side view showing the first embodiment of the lead block of the rotary connector according to the invention, FIG. 6 is a plane view of an essential portion for explaining attachment between the flexible cable and the lead block of the rotary connector according to the invention and FIG. 7 is a side view of the essential portion for explaining attachment between the flexible cable and the lead block of the rotary connector according to the invention.

As shown by FIG. 1, a rotary connector 100 is generally constituted by a fixed side housing 1, a movable side housing 2 rotatably connected to the fixed side housing 1, two sheets (a plurality of sheets) of a first and a second flexible cable 3 and 4 constituting flat cables contained at inside of a space 16 formed between the fixed and the movable side housings 1 and 2, a moving member 5 pivotably arranged between the fixed side and the movable side housings 1 and 2, and a total of two pieces of a first and a second lead block 6 and 7 connected piece by piece to respective both end sides of two of the first and the second flexible cables 3 and 4.

The fixed side housing 1 is provided with an outer cylinder 8 in a cylindrical shape, a bottom wall (not illustrated) in a circular shape provided at an end of the outer cylinder 8 and a circular hole (not illustrated) provided at a central portion of the bottom wall. Meanwhile, the movable side housing 2 is provided with an inner cylinder 9 in a cylindrical shape and an upper wall (not illustrated) substantially in a circular ring shape provided at one end of the inner cylinder 9, the outer cylinder 8 and the inner cylinder 9 are coaxially arranged and there is partitioned a containing portion 10 in a ring-like shape constituting the space 16 between the two outer and inner cylinders 8 and 9.

The moving member 5 is arranged at inside of the containing portion 10 and the moving member 5 is constituted by a rotary plate 11 in a ring-like shape, a group of a plurality of rollers 12 axially supported on the rotary plate 11 and a pair of fixed columns 13 in a cylindrical shape each having a circular hollow hole. The pair of fixed columns 13 are formed integrally with the rotary plate 11. Further, between one of the fixed columns 13 and the roller 12, there is formed a first opening 14 inserted with the first flexible cable 3 and between other of the fixed columns 13 and the roller 12, there is formed a second opening 15 inserted with the second flexible cable 4.

Each of two of the first and the second flexible cables 3 and 4, is pasted with a plurality (for example, four) of conductors 23 comprising copper (Cu) or the like having a very thin dimension in a strip-like shape between two insulating films comprising insulating tapes in a strip-like shape of polyethylene terephthalate (PET) or the like. Outer ends of two of the first and the second flexible cables 3 and 4, are mechanically and electrically connected to the lead block 6 constituting a fixed side joint fixed to the outer cylinder 8 and are led out electrically to outside of the fixed side housing 1 via the lead block 6.

Further, inner ends of the first and the second flexible cables 3 and 4, are electrically and mechanically connected to the lead block 7 constituting a movable side joint fixed to the inner cylinder 9 and are electrically led out to outside of the movable side housing 2 via the lead block 7.

Here, the first and the second flexible cables 3 and 4 are wound around in the counterclockwise direction from the lead block 6 along an inner wall of the outer cylinder 8 in a state of disposing the first flexible cable 3 on an inner side and thereafter branched, the first flexible cable 3 passes through the first opening 14 and turned back in a U-like shape by one of the group of rollers 12, the second flexible cable 4 passes through the second opening 15 and is turned back in a U-like shape by another one of the group of rollers 12, further, the first and the second flexible cables 3 and 4 are wound around a peripheral face of the inner cylinder 9 in the clockwise direction in a state of disposing the second flexible cable 4 on an inner side and thereafter, contained at inside of the containing portion 10 to reach the lead block 7.

Here, a detailed explanation will be given of connection between the flexible cable and the lead block of the rotary connector 100 according to the invention as follows As shown by FIG. 2 and FIG. 3, the flexible cable 3 (4) in a strip-like shape constituting the flat cable, is provided with first and second insulating films 21 and 22 comprising a resin material of, for example, polyethylene terephthalate (PET) or the like, formed in a thin film shape, laminated with two sheets thereof and constituting long-sized base films, a plurality (for example, four) of the long-sized conductors 23 comprising copper foils (Cu) or the like arranged in a state in which substantially total portions thereof are sandwiched between the first and the second insulating films 21 and 22, respectively formed by an equal width dimension and arranged in parallel at equal intervals and a plurality (for example, two) of through holes 24 constituting engaging portions provided at predetermined portions of the first and the second insulating films 21 and 22 respectively between the respective conductors 23.

Further, each of the conductors 23 is provided with a first base conductor 23*a* a total portion of which is sandwiched between the first and the second insulating films 21 and 22 and a first exposed conductor 23*b* extended from the first base conductor 23*a*, exposed from front ends of the first and the second insulating films 21 and 22 and projected outwardly.

Further, one face of a front end of each of the first exposed conductors 23*b*, is pasted with a hold film 25 in a strip-like shape comprising PET or the like for holding a free end side of each of the first exposed conductors 23*b*.

Further, such a constitution is provided at both ends of the flexible cable 3 (4) and there are formed a plurality of the flexible cables 3 (4) having the same constitution.

As shown by FIG. 4 and FIG. 5, the lead block 6 (7) is provided with a base 31 and a plurality of first connection terminals 32 arranged to the base 31 by, for example, insert molding.

Further, the base 31 comprises, for example, an insulating synthetic resin material, formed by molding, substantially in a rectangular shape and arranged with a rectangular through hole 31*a* substantially at a central portion of the base 31.

Further, at a front end side (upper side of FIG. 4) of the base 31, there is provided an inclined base 31*b* projected outwardly from an upper face of the base 31 and at predetermined positions on a rear end side (lower side of FIG. 4) of the base 31, there are provided a plurality (for example, two) of positioning portions 31*c* comprising projections substantially in a shape of a circular column projected outwardly from the upper face of the base 31.

The first connection terminals 32 are provided with a plurality (for example, four) of first connections 32*a* comprising a flat plate material of a conductive metal such as copper, formed by pressing, having a predetermined width dimension and arranged at equal intervals, a connection 32*b* for connecting contiguous two pieces (the plurality of pieces) of the first connections 32*a*and a plurality of pieces (for example, 2 pieces) of first outer terminals 32*c* extended outwardly from substantially a central portion of the connection 32*b*. The first connection terminal 32 is integrated with the base 31 by being insert-molded into the inclined base 31*b* of the base 31.

In this state, a substantially central portion of the first connection 32*a* of the first connection terminal 32, is arranged to span above the through hole 31*a* of the base 31, further, a surface of a rear end side (lower side of FIG. 4) of the first connection 32*a* and a surface of the base 31 are formed to dispose at the same plane.

Further, the positioning portion 31*c* is arranged between a pair of the first connections 32*a*.

The upper face of the base 31 of the lead block 6 (7) is laminated and mounted with sides of the plurality of flexible cables 3 (4) formed with the first exposed conductors 23*b*. In this state, the lead block 6 (7) and the respective flexible cable 3 (4) are positioned to each other by inserting the positioning portion 31*c* of the lead block 6 (7) to the respective through hole 24 of the respective flexible cable 3 (4).

Further, in the state of being positioned to each other, the respective connection 32*a* of the lead block 6 (7) and the respective first exposed conductor 23*b* of the flexible cable 3 (4) are arranged to laminate opposedly to each other and the respective first exposed conductor 23*b* is arranged above the through hole 31*a* of the lead block 6 (7).

Further, the respective connection 32*a* and the respective first exposed conductor 23*b* laminated thereto are mechanically and electrically connected by pertinent means such as ultrasonic connecting means.

Further, the plurality of flexible cables 3 (4) constituted in this way and a single lead block 6 (7) are held in an integrated state as shown by FIG. 7.

The rotary connector 100 constituted in this way is used as electric connecting means for an apparatus which needs supply of a large current such as a steering heater apparatus by connecting the fixed side housing 1 to a vehicle body (not illustrated), further, fixing the movable side housing 2 to a steering wheel member (not illustrated), and connecting both ends of the first and the second flexible cables 3 and 4 to respective electric apparatuses on the vehicle body side and on the steering wheel side via the lead blocks 6 and 7 constituting the fixed side and the movable side joints.

That is, the rotary connector 100 functions as electric connecting means by making a predetermined current flow respectively in pluralities (for example, two, four in total) of the respective conductors 23 of the first and the second flexible cables 3 and 4. Thereby, a total amount of a current flowing in the respective conductors 23 is increased.

Next, an explanation will be given of connection of other embodiment of the flexible cable and the lead block of the rotary connector 100 according to the invention. In the following other embodiment, an explanation will be given of members the same as those of the first embodiment by attaching notations the same as those of members of the first embodiment.

Figure 8:
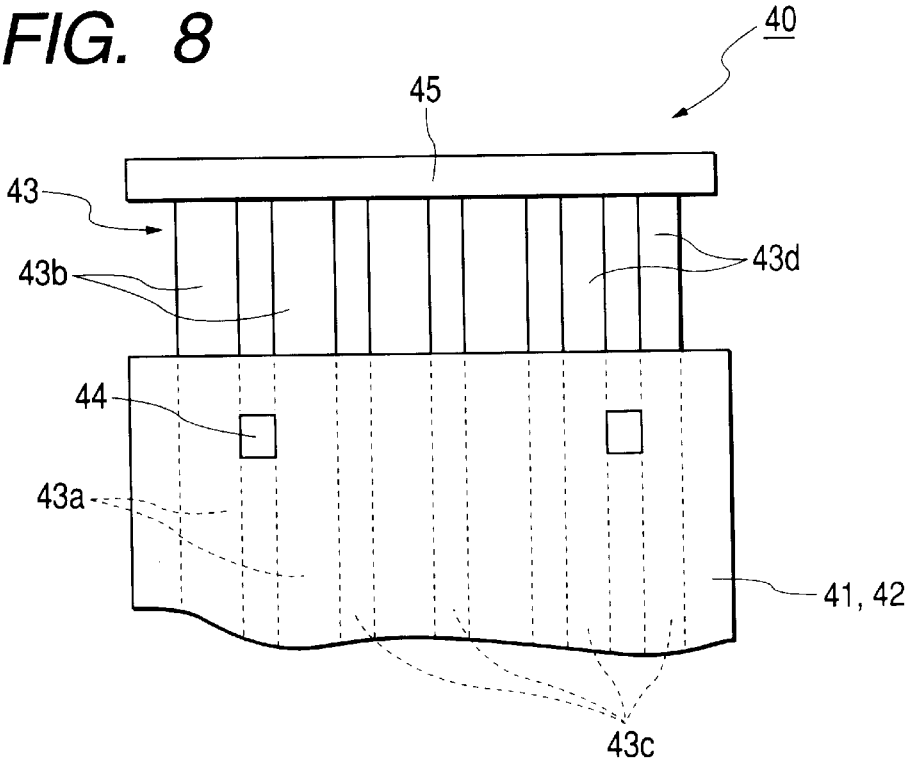
FIG. 8 is a plane view of an essential portion showing a second embodiment of a flexible cable of a rotary connector according to the invention.
Figure 9:
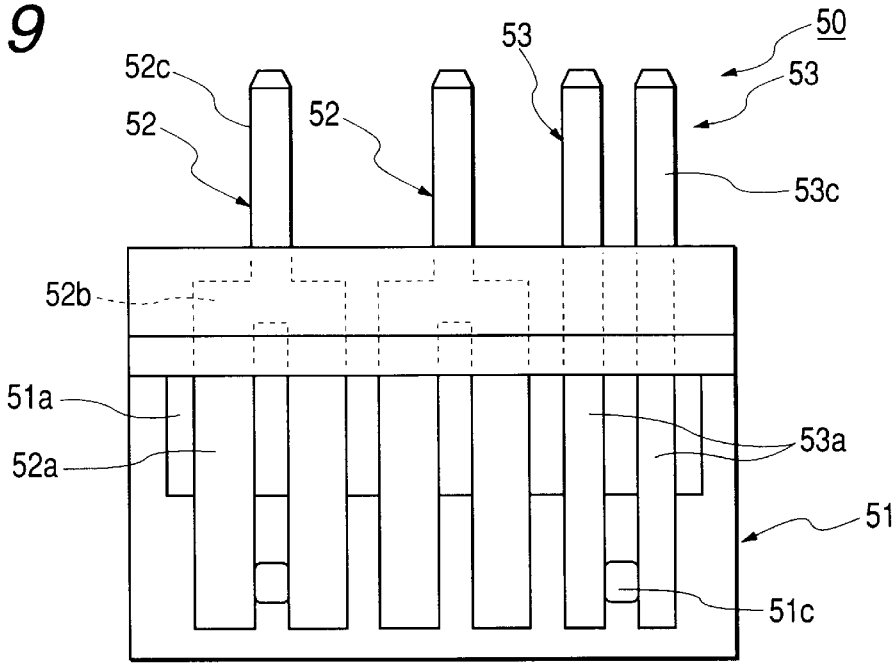
FIG. 9 is a plane view showing a second embodiment of a lead block of the rotary connector according to the invention.
Figure 10:
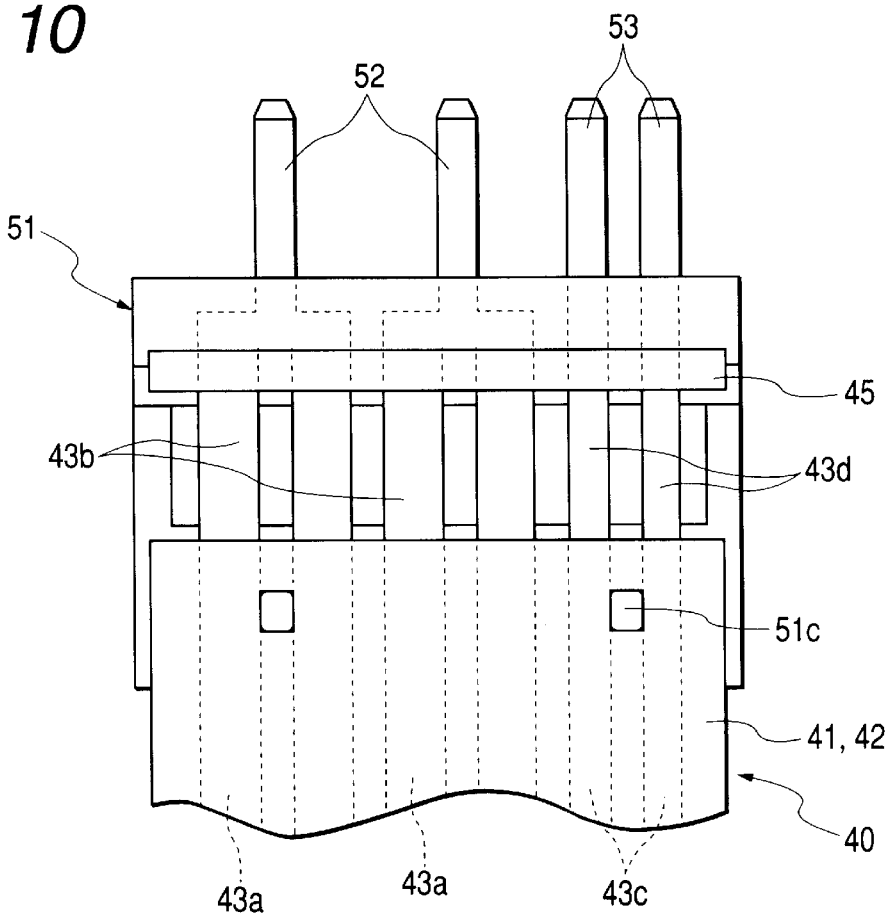
FIG. 10 is a plane view of an essential portion showing the second embodiment of a state of connecting the flexible cable and the lead block of the rotary connector according to the invention.
Figure 11:
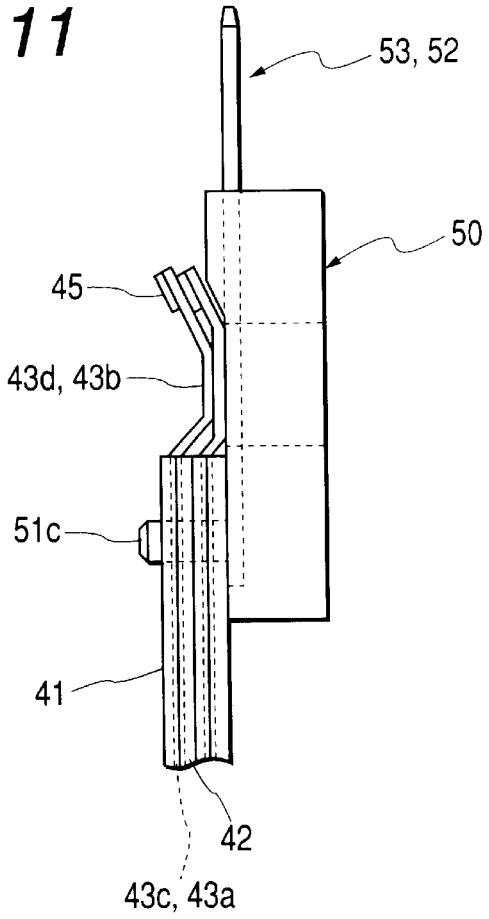
FIG. 11 is a side view of the essential portion showing the second embodiment of the state of connecting the flexible cable and the lead block of the rotary connector according to the invention.

FIG. 8 is a plane view of an essential portion showing a second embodiment of a flexible cable of a rotary connector according to the invention, FIG. 9 is a plane view showing the second embodiment of a lead block of the rotary connector according to the invention, FIG. 10 is a plane view of an essential portion showing the second embodiment of a state of connecting the flexible cable and the lead block of the rotary connector according to the invention and FIG. 11 is a side view of the essential portion showing the second embodiment of the state of connecting the flexible cable and the lead block of the rotary connector according to the invention.

Further, with regard to the state of connecting a second flexible cable and a second lead block of the second embodiment, an explanation will be given by putting an emphasis on a point of a difference from the above-described first embodiment.

First, as shown by FIG. 8, a second flexible cable 40 in a strip-like shape is provided with first and second insulating films 41 and 42 constituting long-sized base films in a strip-like shape, a second conductor 43 in a strip-like shape comprising a plurality (for example, six) of copper foils (Cu) or the like, and a plurality (for example, two) of through holes 44 constituting engaging portions provided at predetermined portions of the first and the second insulating films 41 and 42 respectively among the respective second conductors 43 The constitution is formed substantially similar to the flexible cable 3 (4) according to the above-described first embodiment.

Further, the point of a difference from the flexible cable 3 (4) of the above-described first embodiment, resides in a difference of the constitution of the plurality (for example, six) of the second conductors 43 in the strip-like shape. That is, although the second conductor 43 is arranged in a state in which substantially a total portion thereof is sandwiched between the first and the second insulating films 41 and 42, the second conductors 43 are constituted by a plurality (for example, four) of first base conductors 43*a* having a wide width used for power supply and a plurality (for example, two) of second base conductors 43*c* used for signal, which are provided separately from each other at areas of the first and the second insulating films 41 and 42 divided in twos.

Further, a width dimension of the first base conductor 43*a* for power supply is set to a width dimension thicker (larger) than a width dimension of the second base conductor 43*c* for a signal, and by the difference in the width dimension, a capacity of a current capable of being made to flow to the first base conductor 43*a* is formed to be larger than a capacity of a current capable of being made to flow to the second base conductor 43*c*. In this case, respective interval dimensions between the respective first base conductors 43*a* and the respective second base conductors 43*c* are set to be equal intervals.

Further, the respective second conductors 43 are provided with respective first exposed conductors 43*b* and respective second exposed conductors 43*d* extended from the first base conductors 43*a* and the second base conductors 43*c* respectively exposed from front ends of the first and the second insulating films 41 and 42 and projected outwardly.

One face of each of front ends of the respective first exposed conductors 43*b* and the respective second exposed conductors 43*d* is pasted with a hold film 45 in a strip-like shape comprising PET or the like for holding free end sides of the respective first exposed conductors 43*b* and the respective second exposed conductors 43*d*.

Further, such a constitution is provided at both ends of the second flexible cable 40 and there are formed a plurality of the second flexible cables 40 having the same constitution.

Next, an explanation will be given of a second lead block 50 according to the second embodiment by putting an emphases on a point of a difference from the lead block 30 according to the first embodiment.

As shown by FIG. 9, the second lead block 50 is provided with a base 51, a first connection terminal 52 and a second connection terminal 53 provided in parallel with the first connection terminal 52. Further, the base 51 is arranged with a plurality (for example, two) of positioning portions 51*c*.

The first connection terminal 52 of the second lead block 50 is constructed by a constitution similar to that of the first connection terminal 32 (refer to FIG. 4) having the first connection 32*a* according to the above-described first embodiment and is provided with a first connection 52*a*, a connection 52*b* and a first outer terminal 52*c*.

Further, next, the second connection terminal 53 is provided with a second connection 53*a* comprising a flat plate material of a conductive metal such as copper, formed by pressing and having a predetermined width dimension and a second outside terminal 53*c* extended outwardly from the second connection 53*a*.

Further, a width dimension of the second connection 53*a* of the second connection terminal 53 is formed by a width dimension slenderer than a width dimension of the first connection 52*a* of the first connection terminal 52.

Further, the width dimension of the first connection 52*a* and the width dimension of the first exposed conductor 43*b* are set to substantially the same width dimension, further, the width dimension of the second, connection 53*a* and the width dimension of the second exposed conductor 43*d* are set to substantially the same width dimension.

Further, the first connection 52*a* and the second connection 53*a* are provided separately from each other at areas of the base 51 divided in two.

Further, as shown by FIG. 10 and FIG. 11, an upper face of the base 51 of the second lead block 50 is laminated and mounted with sides of a plurality of sheets (for example, 2 sheets) of the second flexible cables 40 formed with the first exposed conductor 43*b* and the second exposed conductor 43*d*. In this state, the second lead block 50 and the respective second flexible cables 40 are positioned to each other by inserting the positioning portion 51*c* of the second lead block 50 into the respective through hole 44 of the respective second flexible cable 40.

Further, in the state of being positioned to each other, the first and the second connections 52*a* and the 53*a* of the second lead block 50 respectively and the first and the second exposed conductors 43*b* and 43*d* of the second flexible cable 40 respectively are arranged to laminate opposedly to each other, further, the first and the second exposed conductors 43*b* and 43*d* are respectively arranged above a through hole 51*a* of the second lead block 50.

Further, the first and the second connections 52*a* and 53*a* respectively and the first and the second exposed conductors 43*b* and 43*d* respectively laminated thereon are mechanically and electrically connected by pertinent means such as ultrasonic connecting means or the like.

Further, a plurality of the second flexible cables 40 constituted in this way and a single second lead block 50 are held in an integrated state.

By the state, a large current of, for example, a heater apparatus or the like can be made to flow to the first connection terminal 52, further, a small current of, for example, an air bag apparatus or the like can be made to flow to the second connection terminal 53.

Further, although according to the first and the second embodiments, mentioned above, the constitution of the respective flexible cable as the flexible cable is constructed by the constitution in which the first base conductor in the strip-like shape is sandwiched between two insulating films, the constitution of the flexible cable is not limited thereto but there may be constructed a constitution in which the first base conductor in the strip-like shape is pasted on one face (face on one side) of one sheet of the insulating film.

Here, next, an explanation will be given of a connection between a flexible cable and a lead block according to a third embodiment of the rotary connector 100 of the invention.

Figure 12:
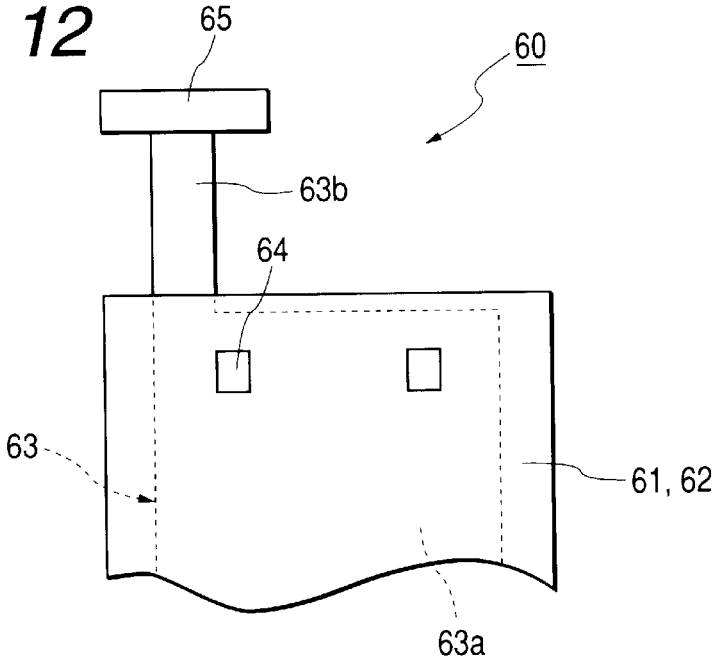
FIG. 12 is a plane view of a first essential portion showing a third embodiment of a first flexible cable of a rotary connector according to the invention.
Figure 13:
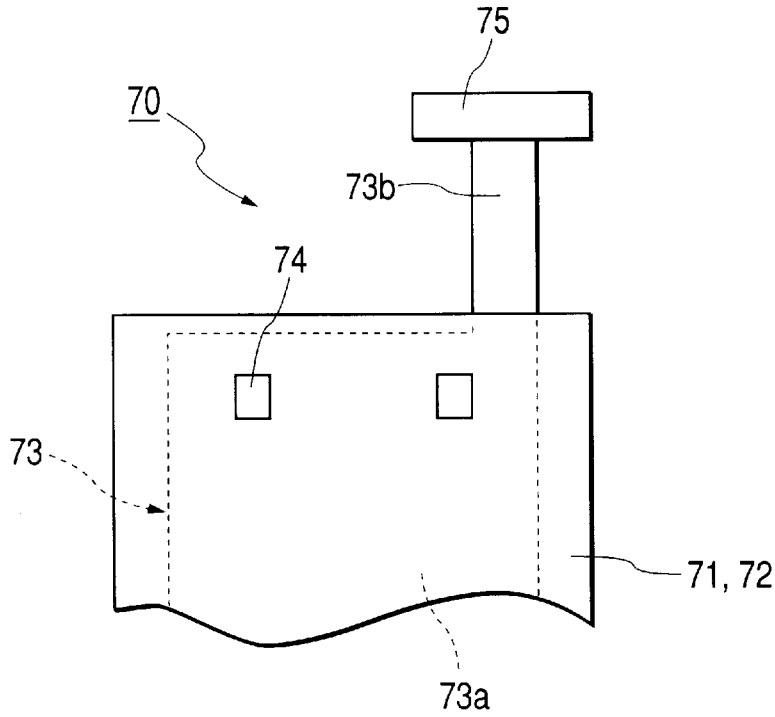
FIG. 13 is a plane view of a first essential portion showing a third embodiment of a second flexible cable of the rotary connector according to the invention.
Figure 14:
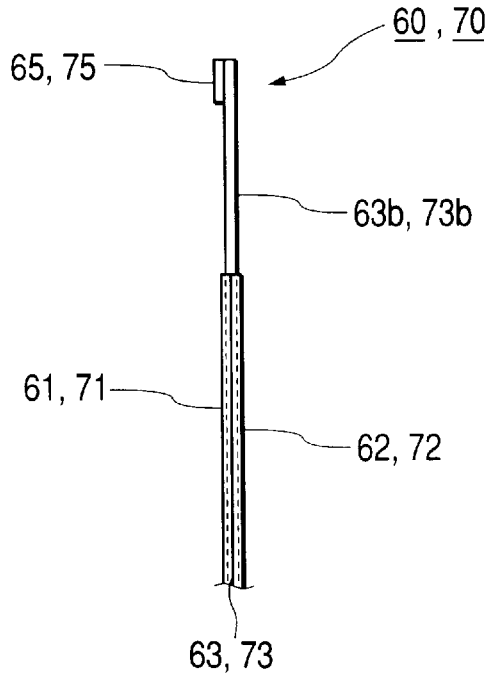
FIG. 14 is a side view of the essential portion showing the third embodiment of the first flexible cable of the rotary connector according to the invention.
Figure 15:
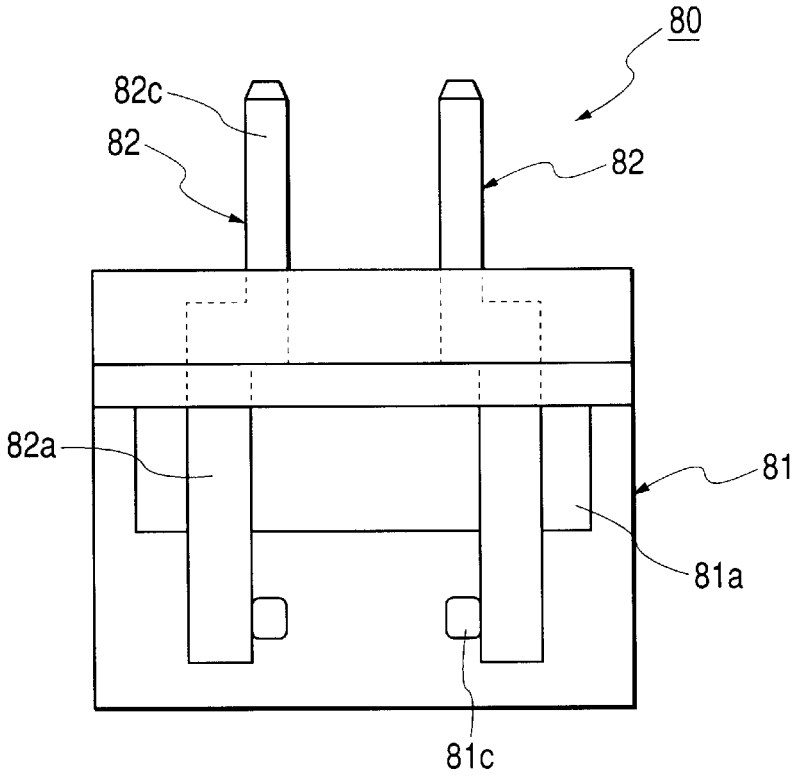
FIG. 15 is a plane view showing the third embodiment of a lead block of the rotary connector according to the invention.
Figure 16:
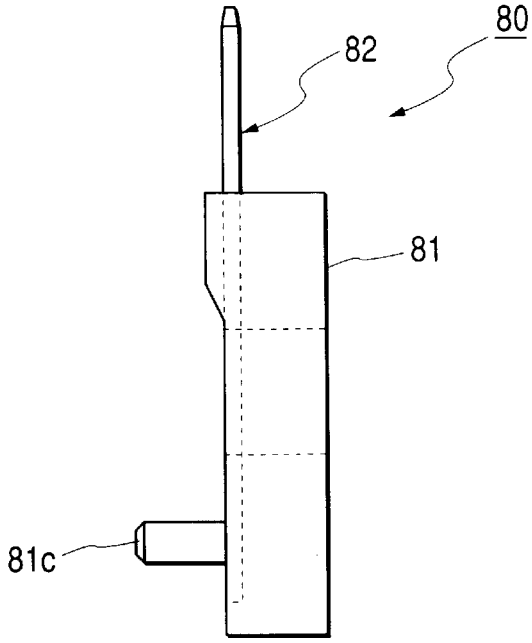
FIG. 16 is a side view showing the third embodiment of the lead block of the rotary connector according to the invention.
Figure 17:
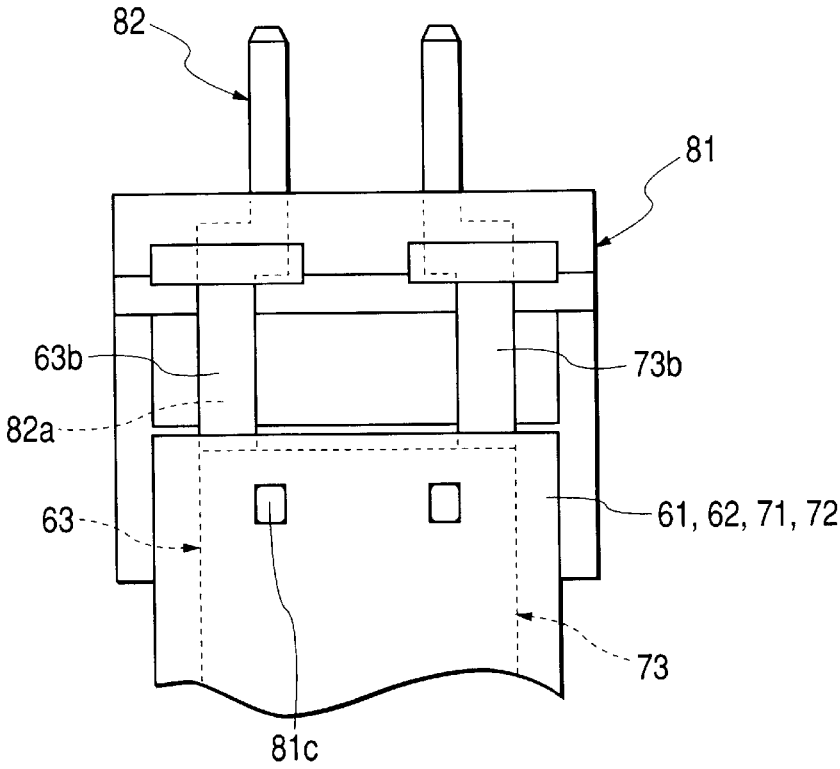
FIG. 17 is a plane view of an essential portion showing the third embodiment of a state of connecting the flexible cable and the lead block of the rotary connector according to the invention.
Figure 18:
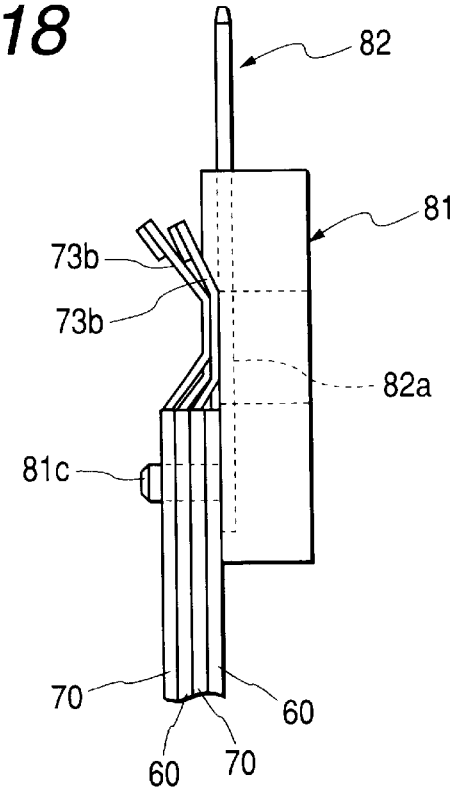
FIG. 18 is a side view of the essential portion showing the third embodiment of the state of connecting the flexible cable and the lead block of the rotary connector according to the invention.

FIG. 12 is a plane view of an essential portion showing a third embodiment of a first flexible cable of a rotary connector according to the invention, FIG. 13 is a plane view of an essential portion showing the third embodiment of a second flexible cable of the rotary connector according to the invention, FIG. 14 is a side view of the essential portion showing the third embodiment of the first flexible cable of the rotary connector according to the invention, FIG. 15 is a plane view showing the third embodiment of a lead block of the rotary connector according to the invention, FIG. 16 is a side view showing the third embodiment of the lead block of the rotary connector according to the invention, FIG. 17 is a plane view of an essential portion showing the third embodiment of a state of connecting the first and the second flexible cables and the lead block of the rotary connector according to the invention and FIG. 18 is a side view of the essential portion showing the third embodiment of the state of connecting the first and the second flexible cables and the lead block of the rotary connector according to the invention.

Further, an explanation will be given of the state of connecting the first and the second flexible cabled and the lead block according to the third embodiment by putting an emphasis on a point of a difference from the above-described embodiment.

First, as shown by FIG. 12 and FIG. 14, a first flexible cable 60 in a strip-like shape is constituted by first and second insulating films 61 and 62 constituting base films in a strip-like shape and a copper foil (Cu) and the like and is provided with a long-sized first conductor 63 in a strip-like shape and a plurality (for example, two) of through holes 64 constituting engaging portions provided at predetermined portions of the respective first and second insulating films 61 and 62 within an area of the third conductor 63.

Further, a single first conductor 63 is provided with a first base conductor 63*a* a total portion of which is sandwiched between the first and the second insulating films 61 and 62 and a first exposed conductor 63*b* extended from the first base conductor 63*a*, exposed from front ends of the first and the second insulating films 61 and 62 and projected outwardly. In this state, a width dimension of the single first base conductor 63*a* is set to a width dimension more or less narrower than a width dimension of the first and the second insulating films 61 and 62.

Further, a width dimension of the first exposed conductor 63*b* is set to a width dimension narrower than the width dimension of the first base conductor 63*a*, further, the first exposed conductor 63*b* having the narrow width is extended from one end side (left side of FIG. 12) of a front end of the first base conductor 63*a* having the wide width.

Further, one face of a front end of the first exposed conductor 63*b* is pasted with a hold film 65 in as trip-like shape comprising PET or the like for holding a free end side of the respective first exposed conductor 63*b*.

Further, such a constitution is provided at the both ends of the first flexible cable 60 and there are formed a plurality (for example, two) of the first flexible cables 60 having the same constitution.

Next, as shown by FIG. 13, a second flexible cable 70 in a strip-like shape is provided with a constitution substantially the same as the constitution of the first flexible cable 60 mentioned above, and an explanation will be given of a point of a difference therebetween.

The second flexible cable 70 is provided with a first and a second insulating film 71 and 72, a single second conductor 73 and a plurality (for example, two) of through holes 74.

The second conductor 73 having such a constitution is provided with a first base conductor 73*a* and a third exposed conductor 73*b* extended from the first base conductor 73*a*, exposed from front ends of the first and the second insulating films 71 and 72 and projected outwardly. In this state, a width dimension of the first base conductor 73*a* of a single second conductor 73 is set to a width dimension more or less narrower than a width dimension of the first and the second insulating films 71 and 72 and to a width dimension substantially the same as the first base conductor 63*a* of the first conductor 63, mentioned above Further, a width dimension of the first exposed conductor 73*b* of the second conductor 73 is set to a width dimension narrower than the width dimension of the first base conductor 73*a*, further, the third exposed conductor 73*b* having the narrow width is extended from other end side (right side of FIG. 13) of a front end of the first base conductor 73*a* having the wide width.

Further, one face of a front end of the third exposed conductor 73*b* is pasted with a hold film 75 in a strip-like shape comprising PET or the like for holding a free end side of the respective third exposed conductor 73*b*.

Further, such a constitution is provided at the both end of the second flexible cable 70 and there are formed a plurality (for example, two) of the second flexible cable 70 having the same constitution.

Next, an explanation will be given of a lead block 80 according to the third embodiment by putting an emphasis on a point of a difference from the lead block 6 (7) of the first embodiment.

As shown by FIG. 15 and FIG. 16, the lead block 80 is provided with a base 81 and a plurality (for example, two) of first connection terminals 82. Further, the base 81 is arranged with a plurality (for example, two) of positioning portions 81*c* constituting projections.

The first connection terminal 82 of the lead block 80 is provided with a first connection 82*a* and a first outer terminal 82*c*. Further, respectively two of the first connections 82*a* and the first outer terminals 82*c* are integrated to the base 81 by insert molding separately from each other by predetermined intervals. Further, a width dimension of the first connection 82*a* of the first connection terminal 82 and a width dimension of the respective first exposed conductors 63*b* and 73*b* of the first and the second conductors 63 and 73 are formed substantially in the same width dimension.

Further, as shown by FIG. 17 and FIG. 18, an upper face of the base 81 of the lead block 80 is laminated and mounted with sides of an even number of sheets (for example, 2 sheets, or 4 sheets) of the first and the second flexible cables 60 and 70 formed with the first exposed conductors 63*b* and the first exposed conductors 73*d* respectively. In this state, the lead block 80 and the first and the second flexible cables 60 and 70 respectively are positioned to each other by inserting the positioning portions 81*c* of the lead block 80 respectively into the respective through holes 64 and 74 of the respective first and the second flexible cables 60 and 70.

Further, in the state of being positioned to each other, the respective first connection 82*a* of the lead block 80 and the respective first exposed conductors 63*b* and 73*b* of the respective first and second flexible cables 60 and 70 are arranged opposedly to each other, further, the respective first exposed conductors 63*b* and the 73*b* are arranged above a through hole 81*a* of the lead block 80.

Further, the first connections 82*a* and the first exposed conductors 63*b* and 73*b* opposed thereto are mechanically and electrically connected by pertinent means of, for example, ultrasonic connecting means or the like.

Further, two (even number) of the first and the second flexible cables 60 and 70 and a single lead block 80 constituted in this way are held in an integrated state.

In the state, the first conductor 63 and the second conductor 73 of the first and the second flexible cables 60 and 70 are used for power supply.

In this state, as shown by FIG. 18, four (two of each) of the first and the second flexible cables 60 and 70 are laminated alternately. Further, the lamination may not be carried out alternately.

Further, in this state, there is constructed a constitution in which a current for power supply is made to flow to the same heater apparatus at the respective first connection terminals 82. Further, the constitution is not limited thereto but there may be constructed a constitution in which a different current is made to flow to the respective first connection terminals 82.

Further, although according to the above-described third embodiment, as the flexible cable, there are used four (two of each) of the flexible cables, the constitution is not limited thereto but an even number sheets of six sheets or more thereof may be used.

Further, in the above-described third embodiment, even numbers of the conductors may be provided to arrange at the same position.

Further, although according to the above-described first and second embodiments, the first connection terminal is provided with pluralities (for example, two) of the first connections, the connections for connecting the first connections and the first outer terminals extended outwardly from the connections, the constitution is not limited thereto but there may naturally be constructed a constitution in which the connection is not provided but the first connection and the first outer terminal are directly connected to each other.

Further, although according to the above-described first and the second embodiments, the engaging portion of the flexible cable is provided between the contiguous base conductors, the constitution is not limited thereto but the engaging portion may be provided at an outer side edge portion of the insulating film or at inside of the base conductor.

Further, although according to the first and the second embodiments, there are used two of the flexible cables, the constitution is not limited thereto but a number of the laminated flexible cables may naturally be, for example, three (odd number), or four (even number) or more, further, other than the flexible cables, there may be arranged a flexible cable formed with a conductor for supplying a signal current.

Figure 19:
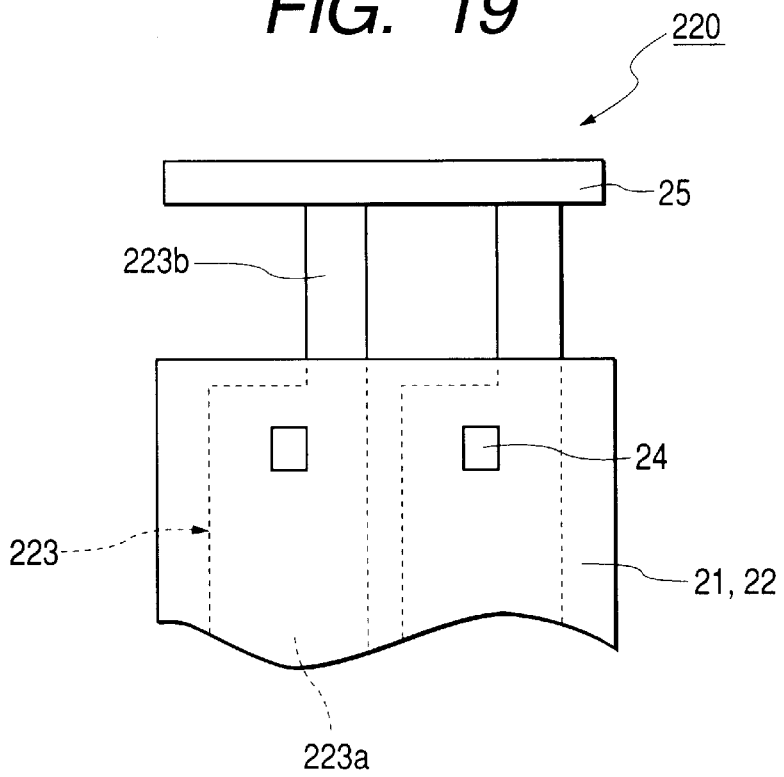
FIG. 19 is a plane view of an essential portion showing a fourth embodiment of a fist flexible cable of a rotary connector according to the invention.
Figure 20:
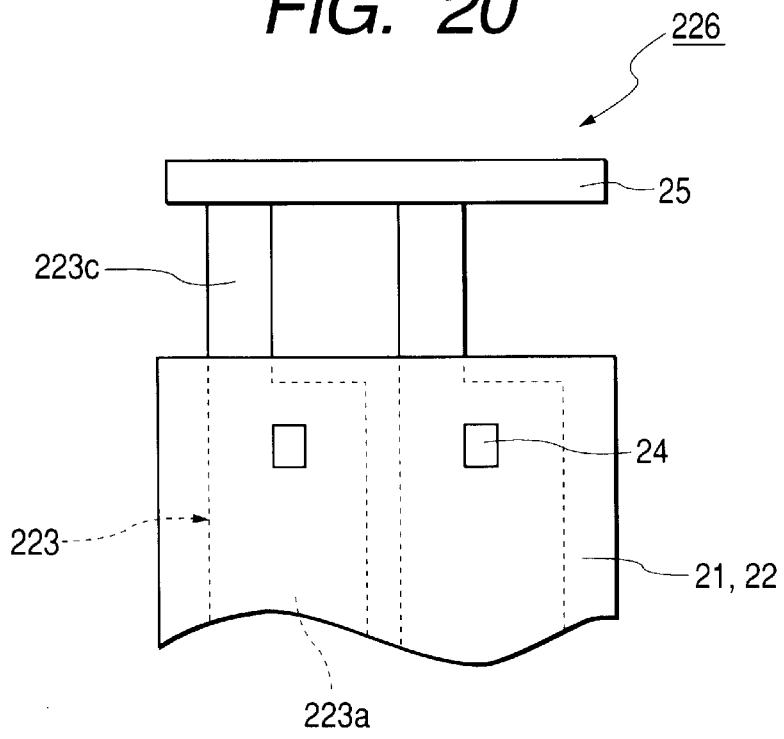
FIG. 20 is a plane view of an essential portion showing a fourth embodiment of a second flexible cable of the rotary connector according to the invention.
Figure 22:
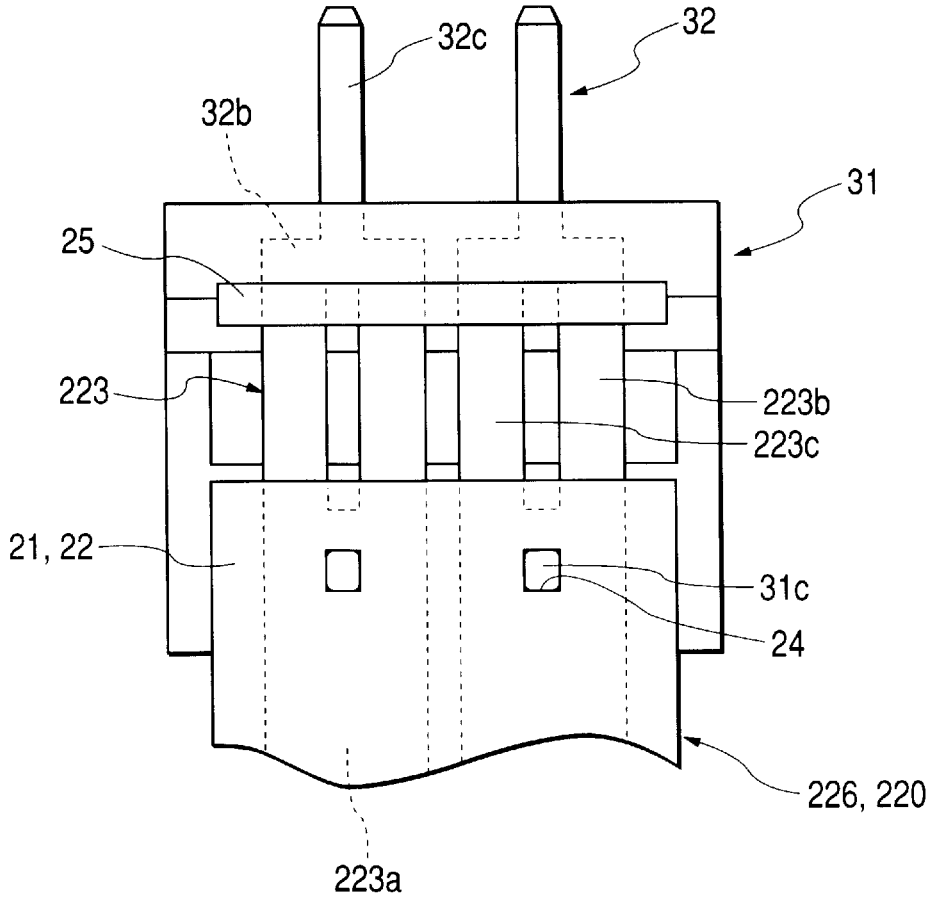
FIG. 22 is a plane view of an essential portion for explaining the fourth embodiment of attachment of the flexible cable and a lead block of the rotary connector according to the invention.
Figure 23:
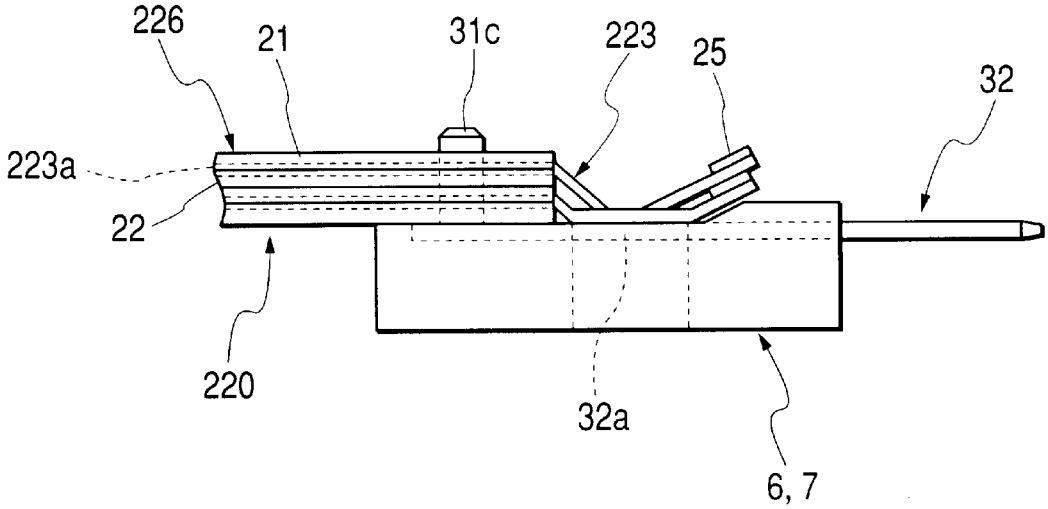
FIG. 23 is a side view of the essential portion for explaining the fourth embodiment of attachment of the flexible cable and the lead block of the rotary connector according to the invention.

Next, an explanation will be given of a connection between a flexible cable and a lead block according to a fourth embodiment of the rotary connector 100 of the invention. FIG. 19 is a plane view of an essential portion showing a fourth embodiment of a first flexible cable of the rotary connector according to the invention, FIG. 20 is a plane view of an essential portion showing the fourth embodiment of a second flexible cable of the rotary connector according to the invention, FIG. 21 is a side view of the first flexible cable of the rotary connector according to the invention, FIG. 22 is a plane view of an essential portion for explaining the fourth embodiment of attachment of the flexible cable and a lead block of the rotary connector according to the invention and FIG. 23 is a side view of the essential portion for explaining the fourth embodiment of attachment of the flexible cable and the lead block of the rotary connector according to the invention.

Figure 21:
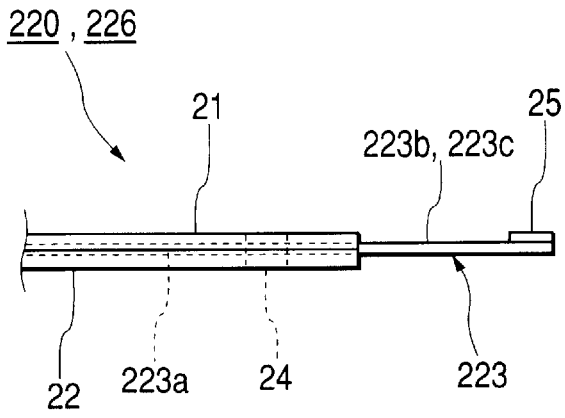
FIG. 21 is a side view of the essential portion showing the fourth embodiment of the first flexible cable of the rotary connector according to the invention.

As shown by FIG. 19 and FIG. 21, a basic constitution of a first flexible cable 220 in a strip-like shape constituting a flat cable is substantially the same as those of the first and the second flexible cables 3 and 4 according to the first embodiment of the invention and therefore, an explanation will be given of a point of a difference therebetween as follows.

Each of conductors 223 is provided with a first base conductor 223*a* having a wide width, a total portion of which is sandwiched between the first and the second insulating films 21 and 22 and a first exposed conductor 223*b* having a narrow width extended from the first base conductor 223*a*, exposed from the front ends of the first and the second insulating films 21 and 22 and projected outwardly. That is, a width dimension of the first exposed conductor 223*b* is set to a width dimension narrower than a width dimension of the first base conductor 223*a*, further, the first exposed conductor 223*b* is extended from one end side (right side of FIG. 19) of a front end of the first base conductor 223*a*.

Further, one face of a front end of each of the first exposed conductors 223*b*, is pasted with the hold film 25 in the strip-like shape comprising PET or the like for holding a free end side of the respective first exposed conductor 223*b*.

Further, such a constitution is provided at both ends of the first flexible cable 220 and there are formed one or a plurality of the first flexible cables 220 having the same constitution.

Next, as shown by FIG. 20, a basic constitution of a second flexible cable 226 in a strip-like shape constituting a flat cable is constructed by a constitution substantially the same as the constitution of the first flexible cable 220, mentioned above, and an explanation will be given of a point of a difference therebetween.

Whereas the first exposed conductor 223*b* having the narrow width of the first flexible cable 220 is extended from one end side (right side of FIG. 19) of the front end of the first base conductor 223*a* having the wide width, a first exposed conductor 223*c* having a narrow width of the second flexible cable 226 is extended from other end side (left side of FIG. 20) of the first base conductor 223*a* having the wide width.

Further, such a constitution is provided at both ends of the second flexible cable 226 and there are formed one or a plurality of second flexible cables 226 having the same constitution.

Further, the first flexible cable 220 and the second flexible cable 226 are arranged to laminate. In this state, the first exposed conductor 223*b* having the narrow width of the first flexible cable 220 and the first exposed conductor 223*c* having the narrow width of the second flexible cable 226 are disposed at different positions of the ends of the first and the second insulating films 21 and 22 and are brought into a state of not being laminated to each other.

As shown by FIG. 22 and FIG. 23, the upper face of the base 31 of the lead block 6 (7) the same as the lead block according to the first embodiment is laminated and mounted with sides of a plurality of the first and the second flexible cables 220 and 226 respectively formed with the first exposed conductors 223*b* and 223*c*. In this state, the lead block 30 and the first and the second flexible cables 220 and 226 respectively are positioned to each other by inserting the positioning portions 31*c* of the lead block 30 into the respective through holes 24 of the first and the second flexible cables 220 and 226.

Further, in the state of being positioned to each other, the respective connections 32*a* of the lead block 30 and the respective first exposed conductors 223*b* and 223*c* of the first and the second flexible cables 220 and 226 are arranged opposedly to each other, further, the respective exposed conductors 223*b* and 223*c* are arranged above the through hole 31*a* of the lead block 30.

Further, the respective connection 32*a* and the respective first exposed conductors 223*b* and 223*c* laminated thereto, are mechanically and electrically connected by pertinent means such as ultrasonic connecting means or the like.

Thereby, there is brought about the state in which one of the connections 32*a* constituting a bifurcated shape, is connected with one of the conductors 223 of the first and the second flexible cables 220 and 226 and the other of the connections 32*a* is connected with other of the conductors 223 of the first and the second flexible cables 220 and 226.

Further, a plurality of the laminated first and the second flexible cables 220 and 226 constituted in this way and a single piece of the lead block 30 are held in an integrated state.

Further, in this state, the overlapped respective first base conductors 223*a* of the first and the second flexible cables 220 and 226 are connected to the same first connection terminal 32 and the same current flows therein.

That is, the rotary connector 100 functions as electric connecting means by making a predetermined current flow respectively in the plurality of respective conductors 223 of two of the first and the second flexible cables 220 and 226.

Here, next, an explanation will be given of a connection of a fifth embodiment of a flexible cable and a lead block of the rotary connector 100 according to the invention.

Figure 24:
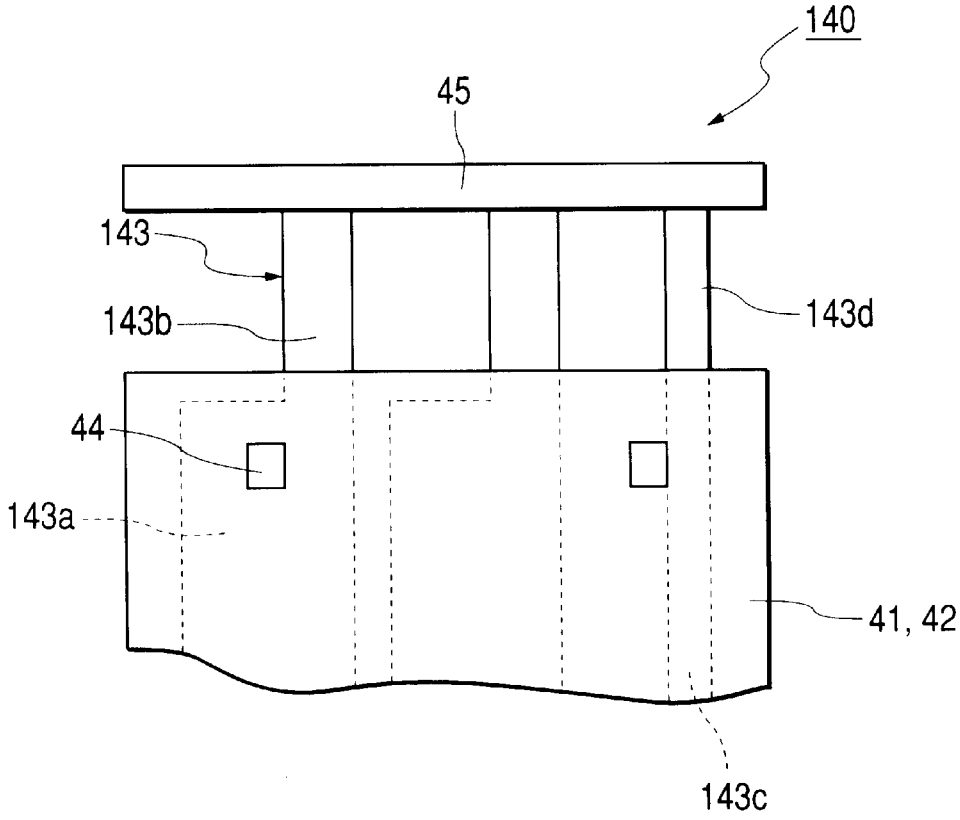
FIG. 24 is a plane view of an essential portion showing a fifth embodiment of a first flexible cable of a rotary connector according to the invention.
Figure 25:
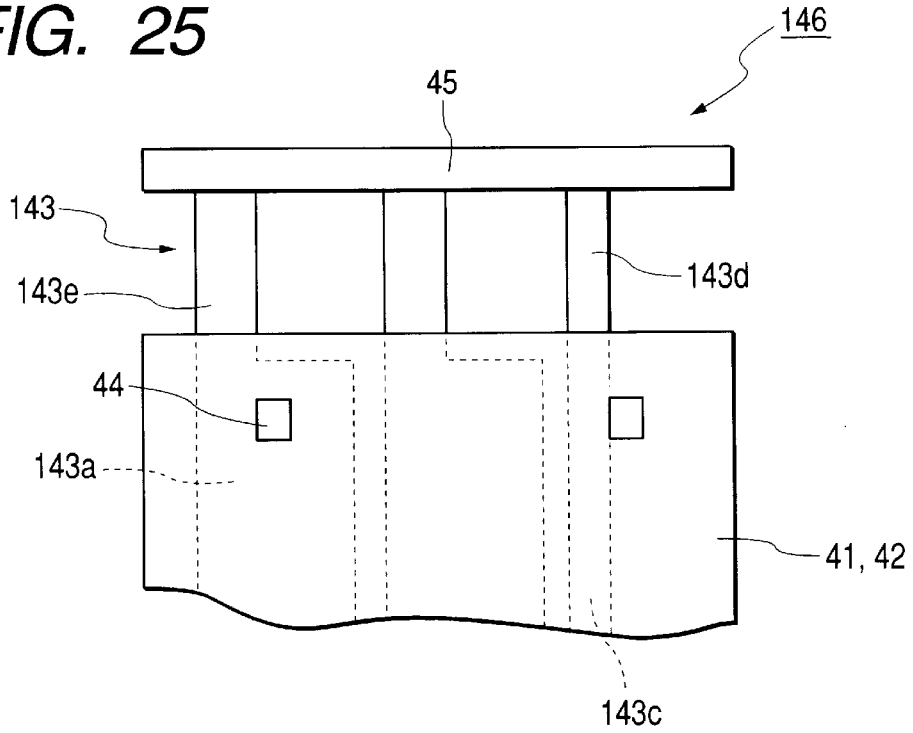
FIG. 25 is a plane view of an essential portion showing the fifth embodiment of a second flexible cable of the rotary connector according to the invention.
Figure 26:
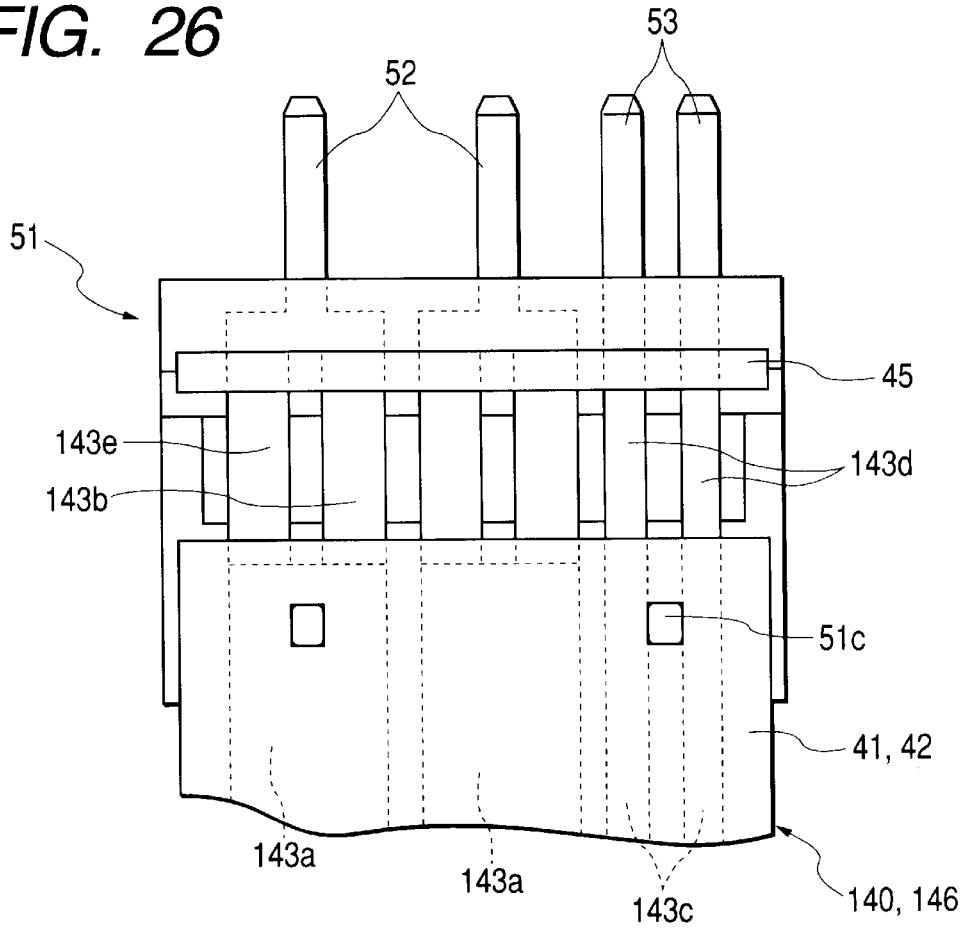
FIG. 26 is a plane view of an essential portion showing the fifth embodiment of a state of connecting the flexible cable and a lead block of the rotary connector according to the invention.
Figure 27:
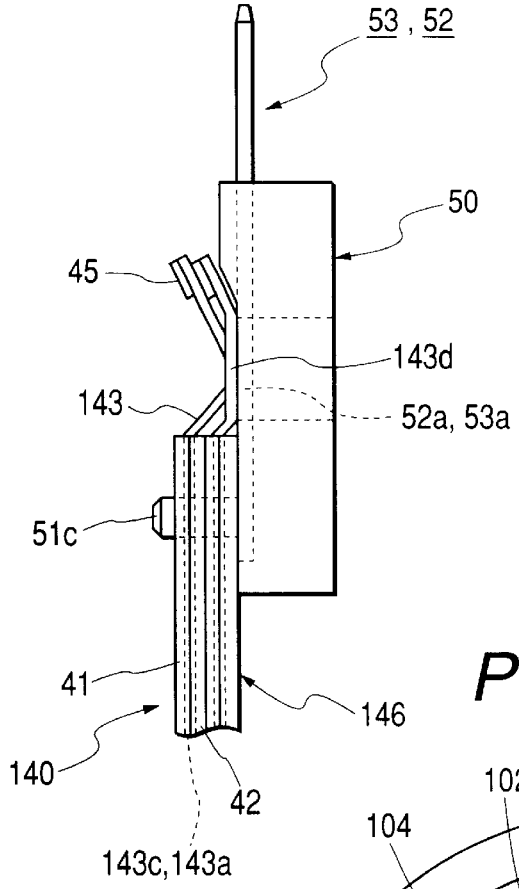
FIG. 27 is a side view of the essential portion showing the fifth embodiment of the state of connecting the flexible cable and the lead block of the rotary connector according to the invention.
Figure 28:
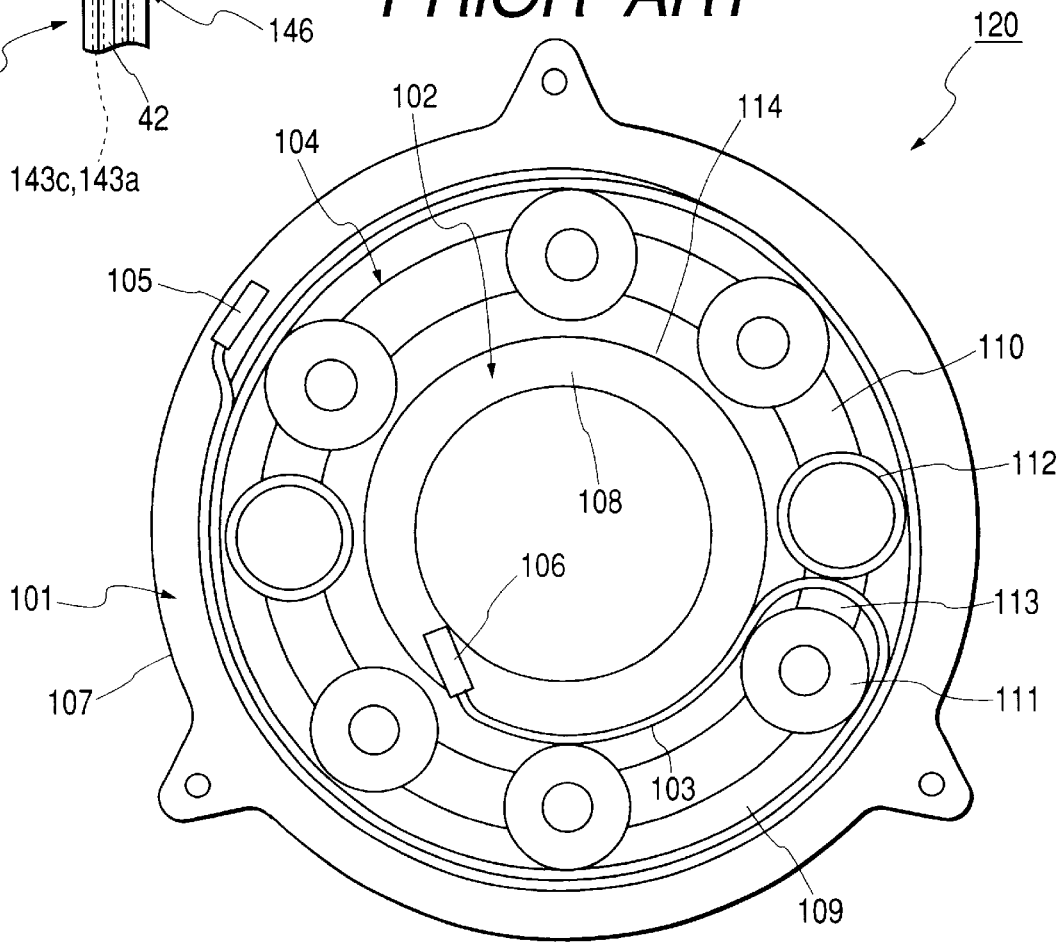
FIG. 28 PRIOR ART
FIG. 28 is a plane view showing a conventional rotary connector.
Figure 29:
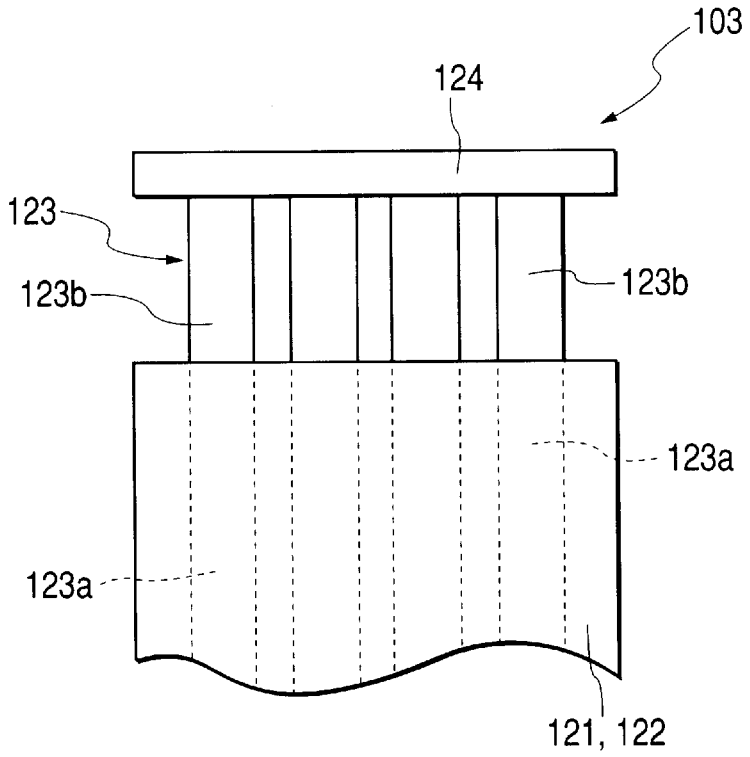
FIG. 29 PRIOR ART
FIG. 29 is a plane view of an essential portion showing a flexible cable of the conventional rotary connector.
Figure 30:
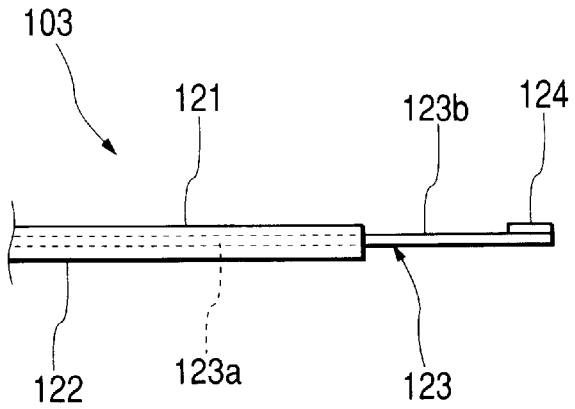
FIG. 30 PRIOR ART
FIG. 30 is a side view of the essential portion showing the flexible cable of the conventional rotary connector.
Figure 31:
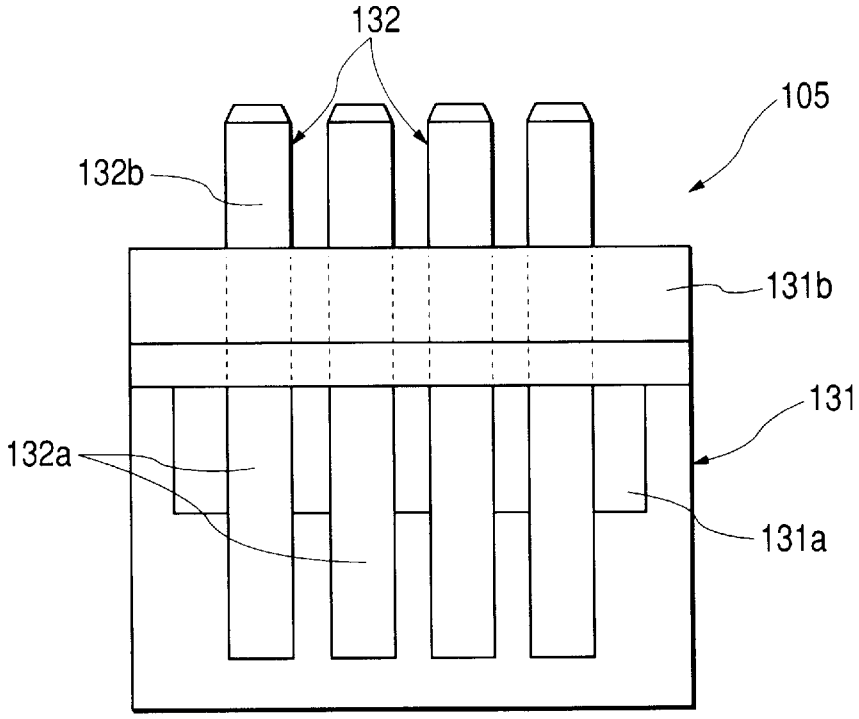
FIG. 31 PRIOR ART
FIG. 31 is a plane view showing a lead block of the conventional rotary connector.
Figure 32:
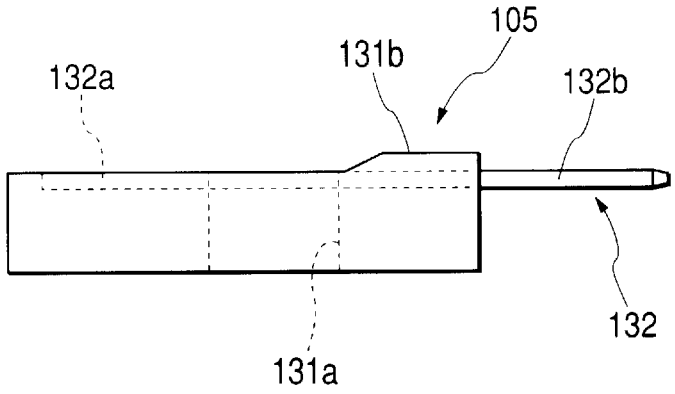
FIG. 32 PRIOR ART
FIG. 32 is a side view showing the lead block of the conventional rotary connector.
Figure 33:
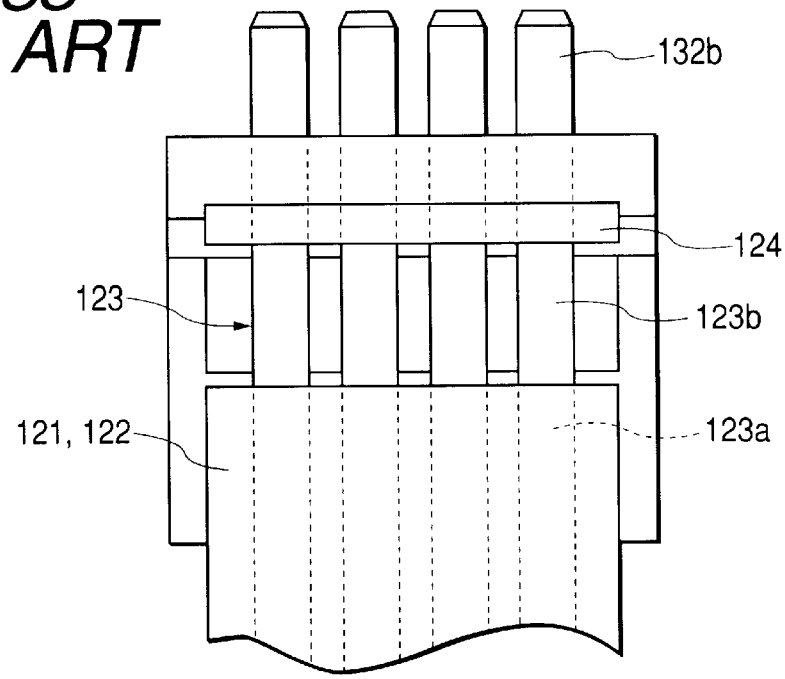
FIG. 33 PRIOR ART
FIG. 33 is a plane view of an essential portion for explaining attachment of the flexible cable and the lead block of the conventional rotary connector.
Figure 34:
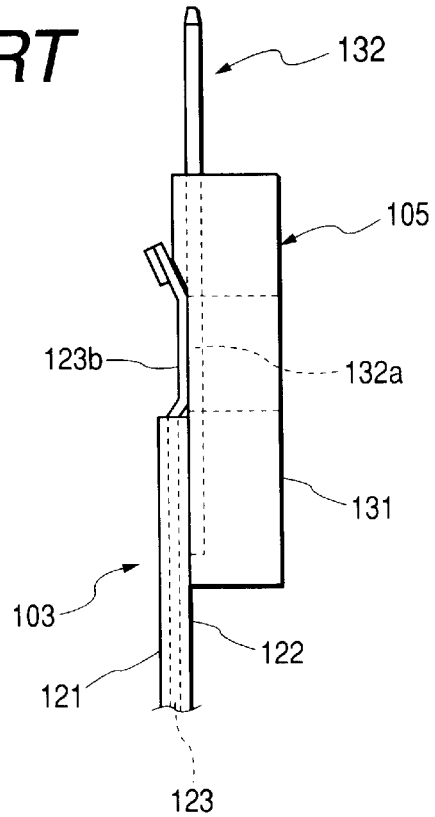
FIG. 34 PRIOR ART
FIG. 34 is a side view of an essential portion for explaining attachment of the flexible cable and the lead block of the conventional rotary connector.

FIG. 24 is a plane view of an essential portion showing a fifth embodiment of a first flexible cable of the rotary connector according to the invention, FIG. 25 is a plane view of an essential portion showing the fifth embodiment of a second flexible cable of the rotary connector according to the invention, FIG. 26 is a plane view of an essential portion showing the fifth embodiment of a state of connecting the flexible cable and the lead block of the rotary connector according to the invention and FIG. 27 is the side view of the essential portion showing the fifth embodiment of the state of connecting the flexible cable and the lead block of the rotary connector according to the invention.

Further, an explanation will be given of the state of connecting the first and the second flexible cables and the lead block according to the fifth embodiment by putting an emphasis on a point of a difference from the above-described fourth embodiment.

First, as shown by FIG. 24, a first flexible cable 140 in a strip-like shape is provided with first and second insulating films 41 and 42 constituting long-sized base films in a strip-like shape, a second conductor 143 in a strip-like shape comprising a plurality (for example, three) of copper foils (Cu) or the like and a plurality (for example, two) of through holes 44 constituting engaging portions provided at predetermined portions of the respective first and second insulating films 41 and 42. The constitution is formed substantially similar to the first flexible cable 120, mentioned above.

Further, the point of a difference from the flexible cable 120 of the above-described first embodiment resides in a difference of a constitution of the plurality (for example, three) of the second conductor 143 in a strip-like shape. That is, the second conductor 143 is arranged in a state in which substantially a total portion thereof is sandwiched between the first and second insulating films 41 and 42 and in such a state, the second conductor 143 is constituted by a plurality (for example, two) of first base conductors 143*a* used for power supply provided separately from each other at areas of the first and second insulating films 41 and 42 divided in two and a single second base conductor 143*c* used for a signal.

Further, a width dimension of the first base conductor 143*a* for power supply is set to a width dimension thicker than a width dimension of the second base conductor 143*c* for a signal, and by the difference between the width dimensions, a capacity of a current capable of being made to flow to the first base conductor 143*a* is formed to be larger than a capacity of a current capable of being made to flow to the second base conductor 143*c*.

In this case, the respective interval dimensions among the respective first base conductors 143*a* and the respective second base conductor 143*c* are set to constitute predetermined intervals.

Further, the respective second conductor 143 is provided with a respective first exposed conductor 143*b* and a respective second exposed conductor 143*d* respectively extended from the first base conductor 143*a* and the second base conductor 143*c*, exposed from front ends of the first and second insulating films 41 and 42 and projected outwardly. In this state, a width dimension of the respective first exposed conductor 143*b* projected outwardly is set to a width dimension narrower than the width dimension of the first base conductor 143*a*, further, the first exposed conductor 143*b* having the narrow width is extended from one end side (right side of FIG. 24) of the front end of the first base conductor 143*a* having the wide width.

Further, a width dimension of the second base conductor 143*c* and a width dimension of the second exposed conductor 143*d* are set to the same width dimension. The second base conductor 143*c* and the second exposed conductor 143*d* of the first flexible cable 140 are arranged to be comparatively proximate to side edge portions of the first and the second insulating films 41 and 42 on one side and are used for a signal.

One face of a front end of each of the first exposed conductor 143*b* and the second exposed conductor 143*d* is pasted with the hold film 45 in a strip-like shape comprising PET or the like for holding free end sides of the respective first exposed conductor 143*b* and the respective second exposed conductor 143*d*.

Further, such a constitution is provided at both ends of the second flexible cable 140 and there are formed one or a plurality of the second flexible cables 140 having the same constitution.

Next, as shown by FIG. 25, a basic constitution of a second flexible cable 146 in a strip-like shape constituting a flat cable is constructed by a constitution substantially the same as the constitution of the above-described first flexible cable 140 and an explanation will be given of a point of a difference therebetween.

Whereas the first exposed conductor 143*b* of the first flexible cable 140 mentioned above is extended from one end side (right side of FIG. 24) of the front end of the first base conductor 143*a*, a first exposed conductor 143*e* having a narrow width of the second flexible cable 146 is extended from other end side (left side of FIG. 25) of the front end of the first base conductor 143*a* having the wide width Further, the second base conductor 143*c* and the second exposed conductor 143*d* of the second flexible cable 146 are arranged to be comparatively separated from side edge portions of the first and the second insulating films 41 and 42 on one side and are used for a signal.

Further, such a constitution is provided at both ends of the second flexible cable 146 and there are formed one or a plurality of the second flexible cables 146 having the same constitution.

Further, the first flexible cable 140 and the second flexible cable 146 are arranged to laminate to each other. In this state, the first exposed conductor 143*b* of the first flexible cable 140 and the first exposed conductor 143*e* of the second flexible cable 146 are provided at different positions of the ends of the first and second insulating films 41 and 42.

Next, a lead block according to the fifth embodiment is the same as the lead block 50 according to the second embodiment shown in FIG. 9.

As shown by FIG. 26 and FIG. 27, the upper face of the base 51 of the lead block 50 according to the fifth embodiment is laminated and mounted with sides of pluralities of the first and second flexible cables 140 and 146 formed with the first exposed conductors 143*b* and 143*e* and the second exposed conductors 143*d*. In this-state, the second lead block 50 and the first and second flexible cables 140 and 146 are positioned to each other by inserting the positioning portions 51*c* of the second lead block 50 into the respective through holes 44 of the first and the second flexible cables 140 and 146.

Further, in the state of being positioned to each other, the respective first and second connections 52*a* and 53*a* of the second lead block 50 and the respective first and second exposed conductors 143*b*, 143*e* and 143*d* of the first and the second flexible cables 140 and 146 are arranged to laminate opposedly to each other, further, the respective first and second exposed conductors 143*b*, 143*e* and 143*d* are arranged above the through hole 51*a* of the second lead block 50.

Further, the respective first and the second connections 52*a* and 53*a* and the respective first and the second exposed conductors 143*b* and 143*d* laminated thereto are mechanically and electrically connected by pertinent means such as ultrasonic connecting means.

Further, two of the first and the second flexible cables 140 and 146 constituted in this way and a single lead block 50 are held in an integrated state.

Further, in this state, the respective first base conductor 143*a* laminated with the first and the second flexible cables 140 and 146 is connected to the same first connection terminal 52, a current for power supply is made to flow therein, further, the respective second base conductor 143*c* is connected to the respectively individual second connection terminal 53 and a current for a signal is made to flow respectively thereof.

Further, although according to the above-described fifth embodiment, an explanation has been given such that a number of the flexible cables is two, the constitution is not limited thereto but the number may naturally be three (odd number), or four (even number) or more.

Further, although according to the above-described fourth and fifth embodiments, an explanation has been given of the constitution in which the first connection terminal is constituted by the bifurcated shape, the constitution is not limited thereto but the first connection terminal may be constituted by a trifurcated shape or a further multifurcated shape or may be constituted by a single piece thereof.

Further, although according to the above-described fourth and fifth embodiment, an explanation has been given such that there are two flexible cables, the constitution is not limited thereto but there may be constructed a constitution in which there are three more of the flexible cables and respective conductors are connected to connections of first connection terminals different from each other.

Further, although according to the above-described fourth and fifth embodiments, two flexible cables are laminated, the constitution is not limited thereto but a number of laminated sheets may be three or more and among them, a conductor may be arranged at the same portion at a portion thereof.

Further, although according to the above-described fourth and fifth embodiments, the constitution of the respective flexible cable as the flexible cable is constructed by the constitution in which the first base conductor in the strip-like shape is sandwiched between two insulating films, the constitution of the flexible cable is not limited thereto but there may be constructed a constitution in which the first base conductor in the strip-like shape is pasted to one face of one insulating film.

Further, although according to the fourth and fifth embodiments, the engaging portion of the flexible cable is provided at inside of the base conductor, the constitution is not limited thereto but the engaging portion may be provided at an outer side edge portion of the insulating film.

As described above, according to the rotary connector of the invention, the respective first exposed conductor provided at the flexible cable is extended at the same position from the respective insulating film and electrically connected to the same respective first connection terminal in a state in which the respective first connection terminal of a single lead block is respectively laminated with the respective first exposed conductors of the plurality of the flexible cables, and by making the same current flow to the first base conductor of the respective flexible cable, there is achieved an effect capable of providing the rotary connector capable of making a current having a large current value flow from the first connection terminal of the single lead block to the plurality of the first base conductors.

As described above, according to the rotary connector of the invention, the respective first exposed conductors provided at least two the flexible cables are extended from the respective insulating films at different positions and electrically connected to the same respective first connection terminals in a state in which the respective first connection terminal of a single lead block is respectively laminated with the respective first exposed conductors of two flexible cables, the same current is made to flow to the first base conductor of the respective flexible cable, thereby, there is achieved an effect capable of providing the rotary connector capable of making a current having a large current value flow from the first connection terminal of the single lead block to the plurality of the first base conductors without increasing the lead blocks.

What is claimed is:

1. A rotary connector comprising:

a fixed side housing;

a movable side housing pivotably mounted to the fixed side housing;

a plurality of flexible cables contained in a space formed between the fixed side housing and the movable side housing in a laminated state; and a lead block having a plurality of first connection terminals connected with the plurality of flexible cables;

wherein in the plurality of flexible cables at least one first base conductor in a strip-like shape is sandwiched between insulating films and includes a first exposed conductor constituted by extending and exposing the first base conductor from the insulating films, wherein the first exposed conductors extended from the respective insulating films at a same position, are electrically connected and laminated to each of the plurality of first connection terminals respectively, and wherein the same current flows to the first base conductors of the plurality of flexible cables.

2. The rotary connector according to claim 1, wherein the first base conductor supplies power for a heater apparatus.

3. The rotary connector according to claim 2, wherein the flexible cable is provided with at least one second base conductor to supply a signal current in parallel with the first base conductor, wherein the lead block is provided with a second connection terminal electrically connected with the second base conductor, and wherein the second base conductor and the second connection terminal are electrically connected.

4. The rotary connector according to claim 3, wherein the first base conductor to supply power for the heater apparatus and a plurality of the second base conductors to supply the signal current are provided separately from each other at areas of the insulating films divided in two.

5. The rotary connector according to claim 3, wherein a width dimension of the first base conductor to supply power for the heater apparatus is set to a width dimension thicker than a width dimension of the second base conductor to supply the signal current, and wherein a current capacity of the first base conductor is larger than a current capacity of the second base conductor.

6. The rotary connector according to claim 1, wherein one of the first connection terminals of the lead blocks includes a plurality of connections connected to each other, and wherein each of the connections is electrically connected with the first exposed conductor.

7. The rotary connector according to claim 1, wherein the lead block is provided with a positioning portion comprising a projection, wherein the flexible cable is provided with an engaging portion fitted with the positioning portion, wherein the engaging portion of the flexible cable is fitted to the positioning portion, and wherein the flexible cable is positioned relative to the lead block.

8. The rotary connector according to claim 7, wherein the engaging portion is provided between contiguous first base conductors among the plurality of first base conductors.

9. A rotary connector comprising:

a fixed side housing;

a movable side housing pivotably mounted to the fixed side housing;

at least two flexible cables contained in a space formed between the fixed side housing and the movable side housing in a laminated state; and a lead block having a plurality of first connection terminals connected with least respective ends of at least the two flexible cables;

wherein in at least the two flexible cables a first base conductor in a strip-like shape is sandwiched between insulating films and includes a first exposed conductor exposed from the insulating films and extended from the first base conductor, wherein the first exposed conductors extended from the respective insulating films of at least the two flexible cables at different positions in a width direction of the insulating films, are electrically connected to the respective first connection terminals and are respectively laminated to the plurality of first connection terminals, and wherein the same current flows to the first base conductors of at least the two flexible cables.

10. The rotary connector according to claim 9, wherein only one of the first base conductors of the flexible cable is provided to the insulating films by a width dimension different from the width dimension of the insulating films.

11. The rotary connector according to claim 10, wherein an even number of sheets not smaller than four layers of at least the two flexible cables each formed with only one of the first base conductors are laminated, and wherein the first exposed conductors of the flexible cables of a number of a half of the even number are extended from the insulating films at the same position.

12. The rotary connector according to claim 10, wherein an even number of layers not smaller than four of the flexible cables each formed with only one of the base conductors are laminated.

13. The rotary connector according to claim 9, wherein a plurality of the first base conductors of each of at least the two flexible cables are provided at the insulating films in parallel with each other.

14. The rotary connector according to claim 13, wherein the plurality of the first base conductors of the flexible cable are provided at the insulating films in parallel with each other, and wherein at least three layers of at least the two flexible cables are laminated.

15. The rotary connector according to claim 14, wherein each of at least the two flexible cables is provided with the first exposed conductor extended from the insulating films at the same position.

16. The rotary connector according to claim 9, wherein the first base conductor supplies power for a heater apparatus.

17. The rotary connector according to claim 16, wherein each of at least the two flexible cables is provided with a second base conductor to supply a signal current in parallel with the first base conductor, wherein the lead block is provided with a second connection terminal electrically connected with the second base conductor, and wherein the second base conductor and the second connection terminal are electrically connected.

18. The rotary connector according to claim 12, wherein the first connection terminal of the lead block includes a plurality of connections connected to each other, and wherein the respective connections are electrically connected with the first exposed conductors of the flexible cables different from each other.

19. The rotary connector according to claim 9, wherein the lead block is provided with a positioning portion comprising a projection, each of at least the two flexible cables is provided with an engaging portion fitted with the positioning portion, wherein the engaging portion of each of at least the two flexible cables is fitted to the positioning portion, and wherein the flexible cable is positioned relative to the lead block.

20. The rotary connector according to claim 9, wherein a number of a half of a plurality of the flexible cables contained in the space formed between the fixed side housing and the movable side housing in the laminated state are turned back at positions different from each other in a U-like shape and provided in the space to be driven at turn-back positions at which the number of the half of the plurality of flexible cables are separated.

* * * * *